US008811866B2

(12) United States Patent
Agatsuma

(10) Patent No.: US 8,811,866 B2
(45) Date of Patent: Aug. 19, 2014

(54) IMAGE FORMING APPARATUS

(75) Inventor: Masahiro Agatsuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 189 days.

(21) Appl. No.: 13/403,695

(22) Filed: Feb. 23, 2012

(65) Prior Publication Data

US 2013/0034366 A1 Feb. 7, 2013

(30) Foreign Application Priority Data

Aug. 1, 2011 (JP) ..... 2011-168148

(51) Int. Cl.
*G03G 15/16* (2006.01)

(52) U.S. Cl.
USPC ..... 399/308; 399/60

(58) Field of Classification Search
CPC combination set(s) only.
See application file for complete search history.

(56) References Cited

U.S. PATENT DOCUMENTS

2009/0080948 A1* 3/2009 Takei ..... 399/308

FOREIGN PATENT DOCUMENTS

JP 2542684 Y2 7/1997

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

An image forming apparatus includes an image bearing member, a detector that detects a density of developer on the image bearing member, a support member supported in the image forming apparatus and removably supporting the detector, a separator disposed with a space from the detector, a first connected unit disposed on the support member between the separator and detector, a second connected unit disposed on the support member on an opposite side of the detector from the first connected unit, a fixing member including a first connecting unit that passes through the space and is supported by the first connected unit and a second connecting unit supported by the second connected unit, where the fixing member fixes the detector to the support member, and a disengagement restricting unit disposed on an opposite side of the detector from the separator so as to be adjacent to the second connecting unit.

18 Claims, 16 Drawing Sheets

IMAGE FORMING APPARATUS

CROSS-REFERENCE TO RELATED APPLICATIONS

This application is based on and claims priority under 35 USC 119 from Japanese Patent Application No. 2011-168148 filed Aug. 1, 2011.

BACKGROUND

Technical Field

The present invention relates to an image forming apparatus.

SUMMARY

According to an aspect of the invention, there is provided an image forming apparatus including an image bearing member that bears a visible image on a surface of the image bearing member, a detecting unit that is disposed so as to face the image bearing member and that detects a density of a developer on the surface of the image bearing member, a support member that removably supports the detecting unit and that is supported by a body of the image forming apparatus, a separating member that is disposed with a space from the detecting unit, a first connected unit that is disposed on the support member between the separating member and the detecting unit, a second connected unit that is disposed on the support member on an opposite side of the detecting unit from the first connected unit, a fixing member that includes a first connecting unit that passes through the space formed between the separating member and the detecting unit and is supported by the first connected unit and a second connecting unit that is supported by the second connected unit, where the fixing member fixes the detecting unit to the support member, and a disengagement restricting unit that is disposed on an opposite side of the detecting unit from the separating member so as to be adjacent to the second connecting unit supported by the second connected unit. If an external force is exerted on the fixing member, the disengagement restricting unit interferes with movement of the second connecting unit and restricts deformation of the fixing member.

BRIEF DESCRIPTION OF THE DRAWINGS

Exemplary embodiments of the present invention will be described in detail based on the following figures, wherein:

FIG. 18A is a perspective view of the detecting unit, and FIG. 18B is a cross-sectional view of the detecting unit supported by a supporting unit;

DETAILED DESCRIPTION

Figure 1:
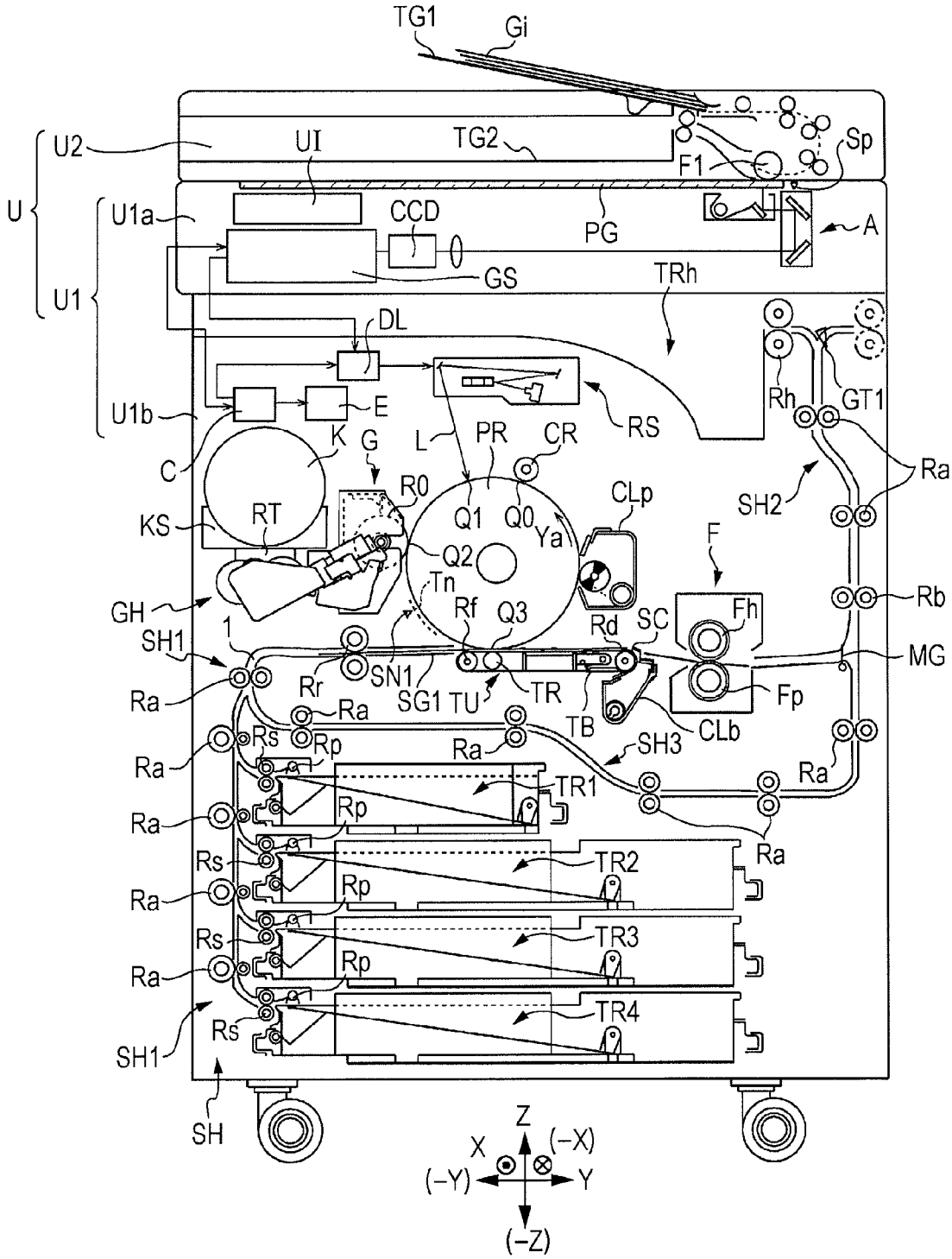
FIG. 1 illustrates an image forming apparatus according to a first exemplary embodiment of the invention.

Exemplary embodiments of the present invention are described below with reference to the accompanying drawings. It should be noted that the present invention is not limited to the following exemplary embodiments. For ease of understanding, in the drawings, a front-rear direction is referred to an "X-axis direction", a right-left direction is referred to as a "Y-axis direction", and an up-down direction is referred to as a "Z-axis direction". In addition, directions indicated by arrows X, −X, Y, −Y, Z, and −Z represent the front direction, the rear direction, the right direction, the left direction, the upward direction, and the downward direction, respectively. Furthermore, in the figures, circles having dots at the center indicate the direction from back to front with respect to the sides illustrated in the figures, and circles having the cross marks therein indicate the direction from front to back with respect to the sides illustrated in the figures. Note that in the figures, a component unnecessary for the description is not illustrated for simplicity.

First Exemplary Embodiment

FIG. 1 illustrates an image forming apparatus according to a first exemplary embodiment of the invention. As illustrated in FIG. 1, a copying machine U, which is an example of the image forming apparatus, includes a copying machine body U1, which is an example of the body of the image forming apparatus, and an automatic document transport device U2. The copying machine body U1 has transparent platen glass PG, which is an example of a platen, on the top surface. The automatic document transport device U2 is removably mounted on the platen glass PG. The automatic document transport device U2 includes a document feeder tray TG1 containing plural stacked document sheets Gi to be copied. The document feeder tray TG1 is an example of a document container. Each of the document sheets Gi placed on the document feeder tray TG1 sequentially passes through a copy point of the platen glass PG and, thereafter, is ejected onto a document paper output tray TG2. The document paper output tray TG2 is an example of a document paper output unit.

The copying machine body U1 includes an operation instruction input unit UI that allows an operator to input an instruction therethrough, an image reading unit U1*a*, an image recording unit U1*b*, and an image processing unit GS. The image reading unit U1*a* and the image recording unit U1*b* are disposed beneath the platen glass PG, and the image recording unit U1*b* is located downstream of the image reading unit U1*a*. The image processing unit GS is disposed in the image reading unit U1*a* or the image recording unit U1*b*. The image reading unit U1*a* serves as a document reading device disposed beneath the transparent platen glass PG, which is disposed on the top surface of the copying machine body U1. The image reading unit U1*a* includes an exposure system registration sensor Sp and an exposure optical system A. The exposure system registration sensor Sp is an example of an exposure system position detecting member disposed at a document reading position.

Movement and stoppage of the exposure optical system A are controlled using a detection signal output from the exposure system registration sensor Sp. Normally, the exposure optical system A stays at a home position which is an example of an image reading position, that is, an initial position. In an automatic document transport operation in which a document is automatically transported using the automatic document transport device U2 and is copied, the exposure optical system A stays at the home position and exposes each of the document sheets Gi that sequentially passes through a copy position F1. In contrast, in a manual document setting operation in which an operator manually places each of the document sheets Gi on the platen glass PG and makes a copy of the document sheet Gi, the exposure optical system A moves and exposure-scans the document sheet Gi. A light beam reflected by the exposed document sheet Gi passes through the exposure optical system A and is collected onto a charge coupled device (CCD). The CCD converts the light beam reflected by the document sheet and collected onto the imaging surface of the CCD into an electric signal.

In addition, the image processing unit GS converts a read image signal input from the CCD of the image reading unit U1*a* into a digital image writing signal and outputs the image writing signal to an image writing light driving signal output device DL of the image recording unit U1*b*. The image writing light driving signal output device DL outputs the image writing light driving signal converted in accordance with the input image data to an exposure device RS. The exposure device RS is an example of an image writing device.

A photorecepter drum PR is disposed beneath the exposure device RS. The photorecepter drum PR is an example of an image bearing member. The photorecepter drum PR rotates in a direction indicated by an arrow Ya. The surface of the photorecepter drum PR is electrically charged by a charging roller CR in a charging region Q0. The charging roller CR is an example of a charging unit. Thereafter, the surface of the photorecepter drum PR is exposure-scanned using a laser beam L at a latent image writing position Q1 and, therefore, an electrostatic latent image is formed. The laser beam L is an example of a latent image writing light beam emitted from the exposure device RS. The surface of the photorecepter drum PR having the electrostatic latent image formed thereon is rotationally moved and passes through a development region Q2 and a transfer region Q3. The transfer region Q3 is an example of an image recording position.

A development unit G that develops the electrostatic latent image in the development region Q2 transports a developer including toner and carrier to the development region Q2 using a development roller R0 and develops the electrostatic latent image that passes through the development region Q2 into a toner image Tn. The development roller R0 is an example of a developer bearing member, and the toner image Tn is an example of an image. The toner image Tn formed on the surface of the photorecepter drum PR is transported to the transfer region Q3. In addition, a density sensor unit SN1 is disposed between the development region Q2 and the transfer region Q3 so as to face the photorecepter drum PR. The density sensor unit SN1 is an example of an image density detection member. The density sensor unit SN1 detects the density of the image formed on the surface of the photorecepter drum PR. According to the first exemplary embodiment, the density sensor unit SN1 detects the density of a preset density detection image, that is, the density of a patch image. A cartridge K is removably mounted in a cartridge mounting member KS. The cartridge K is an example of a developer supply container for supplying developer that is consumed by the development unit G, and the cartridge mounting member KS is an example of a supply container mounting member. The developer in the cartridge K is transported while being churned in a developer container RT. The developer is transported to the development unit G by a developer transport device GH disposed in the developer container RT.

A transfer unit TU that is disposed so as to face the photorecepter drum PR in the transfer region Q3 includes a transfer belt TB. The transfer unit TU is an example of a transfer transport unit, and the transfer belt TB is an example of a medium transport member. The transfer belt TB is rotatably supported by a belt support roller Rd+Rf including a driving roller Rd and a driven roller Rf. The driving roller Rd is an example of a driving member, the driven roller Rf is an example of a driven member, and the belt support roller Rd+Rf is an example of a medium transport member support system. A transfer roller TR is disposed so as to face the photorecepter drum PR with the transfer belt TB therebetween. The transfer roller TR is an example of a transfer unit. In addition, a separating claw SC is disposed so as to face the driving roller Rd. The separating claw SC is an example of a medium separating member. A belt cleaner CLb is disposed downstream of the separating claw SC in the rotation direction of the transfer belt TB. The belt cleaner CLb is an example of a medium-transport-unit cleaning unit. The transfer roller TR transfers the toner image Tn formed on the surface of the photorecepter drum PR to a sheet S. The sheet S is an example of a medium. A transfer voltage having a polarity opposite to the charge polarity of development toner used in the development unit G is supplied from a power supply circuit E to the transfer roller TR. The power supply circuit E is controlled by a controller C. The controller C is an example of a controller.

Each of the sheets S contained in one of paper feed trays TR1 to TR4 is transported to the transfer region Q3 through a sheet feed path SH1. Each of the paper feed trays TR1 to TR4 is an example of a medium container member. The sheet feed path SH1 is an example of a transport path. That is, each of the sheets S contained in one of paper feed trays TR1 to TR4 is picked up by a pickup roller Rp at a predetermined sheet feed point in time and is separated one by one by a separation roller Rs. Thereafter, the sheet S is transported to a regi roller Rr by plural transport rollers Ra. The pickup roller Rp is an example of a medium retrieving member, the separation roller Rs is an example of a medium separation member, the transport roller Ra is an example of a medium transport member, and the regi roller Rr is an example of a medium skew correction member and an example of a medium transport timing control member.

A skew of the sheet S transported to the regi roller Rr is corrected and is transported from a pre-transfer sheet guide SG1 to the transfer belt TB of the transfer unit TU at a time when the toner image Tn formed on the photorecepter drum PR reaches the transfer region Q3, that is, in synchronization with arrival of the toner image Tn at the transfer region Q3. The pre-transfer sheet guide SG1 is an example of a pre-transfer medium guiding member. The toner image Tn developed on the surface of the photorecepter drum PR is transferred to the sheet S by the transfer roller TR in the transfer region Q3. After the transfer, residual toner remaining on the surface of the photorecepter drum PR is removed by a photorecepter member cleaner CLp, and the surface of the photorecepter drum PR is re-charged by the charging roller CR. The photoreceptor member cleaner CLp is an example of an image bearing member cleaning unit.

The sheet S having the toner image Tn transferred thereonto by the transfer roller TR in the transfer region Q3 is separated from the surface of the transfer belt TB by the separating claw SC located downstream of the transfer region Q3. Heat and pressure is applied to the toner image Tn on the separated sheet S in a fixing unit F including a heating roller Fh and a pressurizing roller Fp. The heating roller Fh is an example of a heat-fixing member, and the pressurizing roller Fp is a pressure-fixing member. Thus, the toner image Tn is fixed to the sheet S. Thereafter, the sheet S passes through a mylar gate MG made from an elastic sheet and is transported to a transport roller Rb that is rotatable in forward and backward directions in a sheet ejection path SH2. The mylar gate MG is an example of a transport path switching member, and the sheet ejection path SH2 is an example of an ejection path. The mylar gate MG elastically deforms to lead the sheet S that has passed through the fixing unit F toward the sheet ejection path SH2.

The sheet S to be ejected onto a paper output tray TRh is transported through the sheet ejection path SH2 having the transport roller Rb that is rotatable in forward and backward directions and the plural transport rollers Ra disposed therein. A switching gate GT1 is disposed at the downstream end of the sheet ejection path SH2. The switching gate GT1 is an example of a transport path switching member. If a post-processing apparatus (not illustrated) is connected to the image forming apparatus, the switching gate GT1 can switch between the paper output tray TRh, which is an example of a medium ejection unit, and the post-processing apparatus as a destination of the sheet S. Note that if a post-processing apparatus is not connected to the image forming apparatus, the switching gate GT1 ejects the sheet S that has transported to the downstream end of the sheet ejection path SH2 to the paper output tray TRh. Thus, the sheet S is ejected to the paper output tray TRh by a paper output roller Rh. The paper output roller Rh is an example of a medium ejecting member.

When images are recorded on first and second surfaces of the sheet S and if the sheet S having an image recorded on the first surface is transported to the transport roller Rb that is rotatable in forward and backward directions, the transport roller Rb rotates in the backward direction immediately before the trailing edge of the sheet S having an image recorded on the first surface passes through the transport roller Rb. Accordingly, the sheet S having an image recorded on the first surface is returned toward the sheet ejection path SH2, that is, is switched back. The mylar gate MG leads the sheet S switched back by the transport roller Rb toward a sheet reversing path SH3. The sheet reversing path SH3 is an example of a reversing path. The sheet reversing path SH3 is connected to the sheet feed path SH1 on the upstream side of the regi roller Rr in the medium transport direction. Thus, the sheet S having an image recorded on the first surface and transported to the sheet reversing path SH3 is turned over and is transported to the regi roller Rr again. Thereafter, as in the case where the image is recorded on the first surface, the sheet S is transported to the transfer region Q3. In this way, a toner image Tn is transferred onto the second surface of the sheet S having an image recorded on the first surface. Note that a medium transport path SH is formed from elements indicated by reference symbols SH1 to SH3.

Image Density Detection Member

Figure 2:
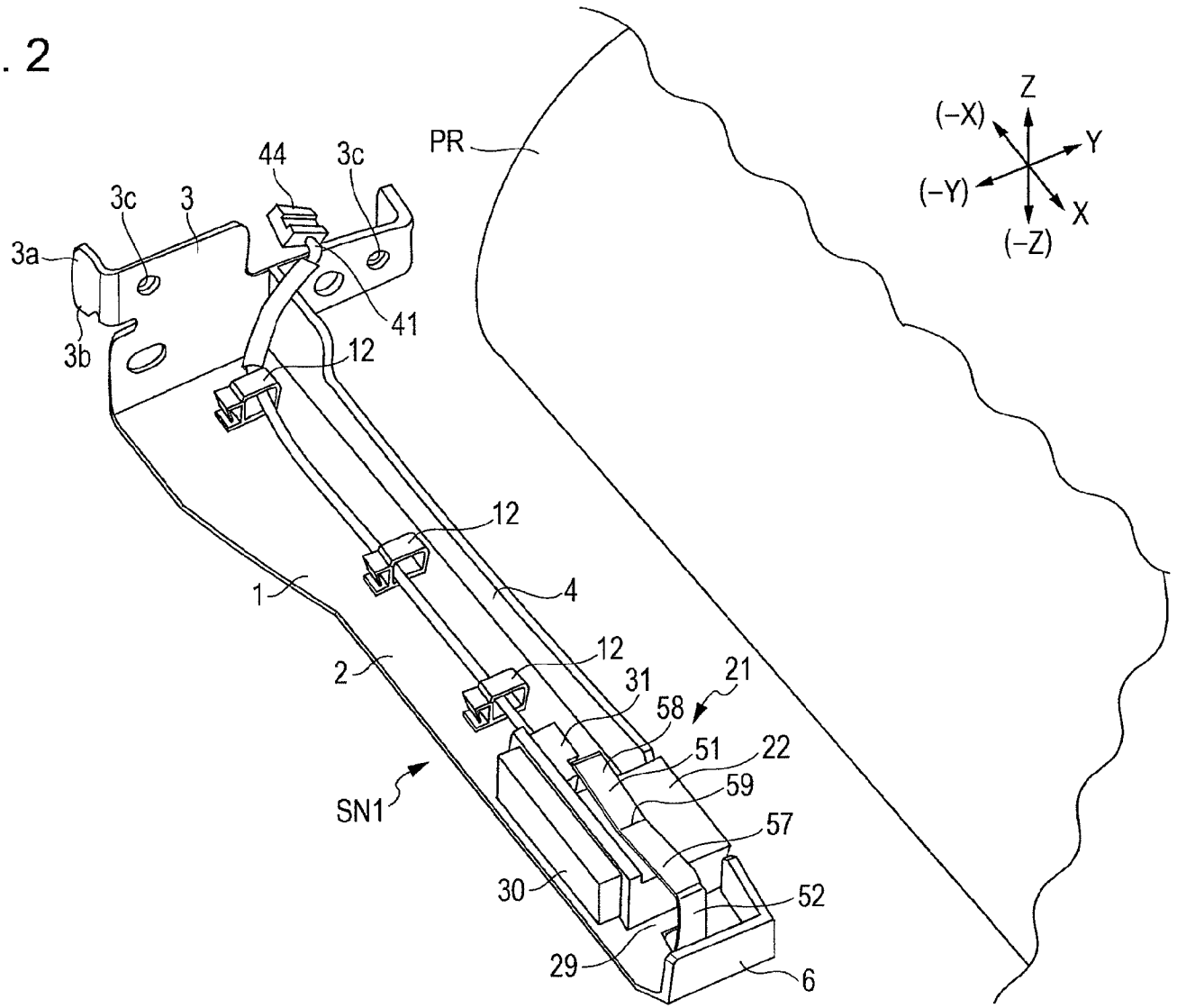
FIG. 2 is a perspective view of a detection member according to a first exemplary embodiment of the invention.
Figure 3:
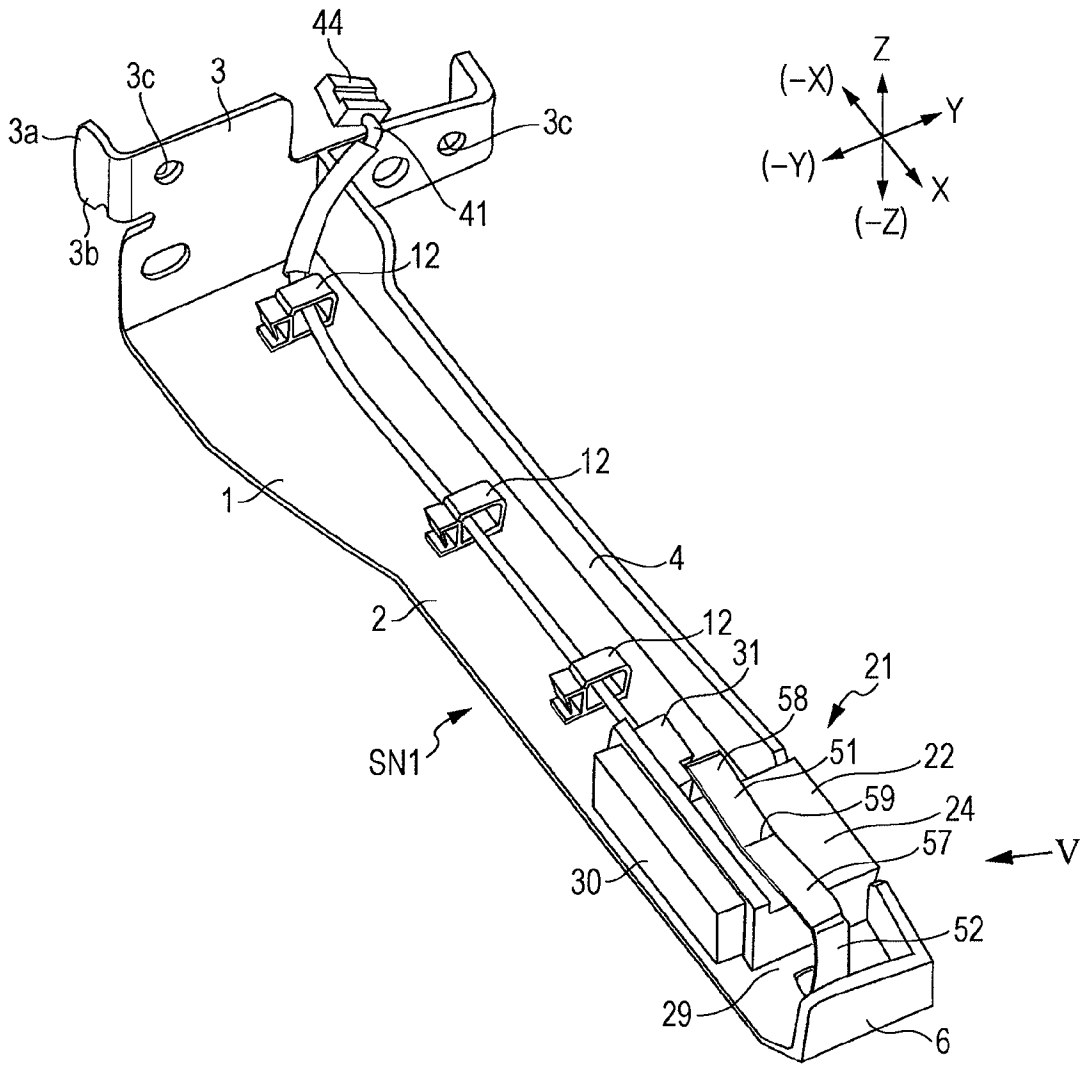
FIG. 3 illustrates the components of the detection member according to the first exemplary embodiment of the invention.
Figure 4:
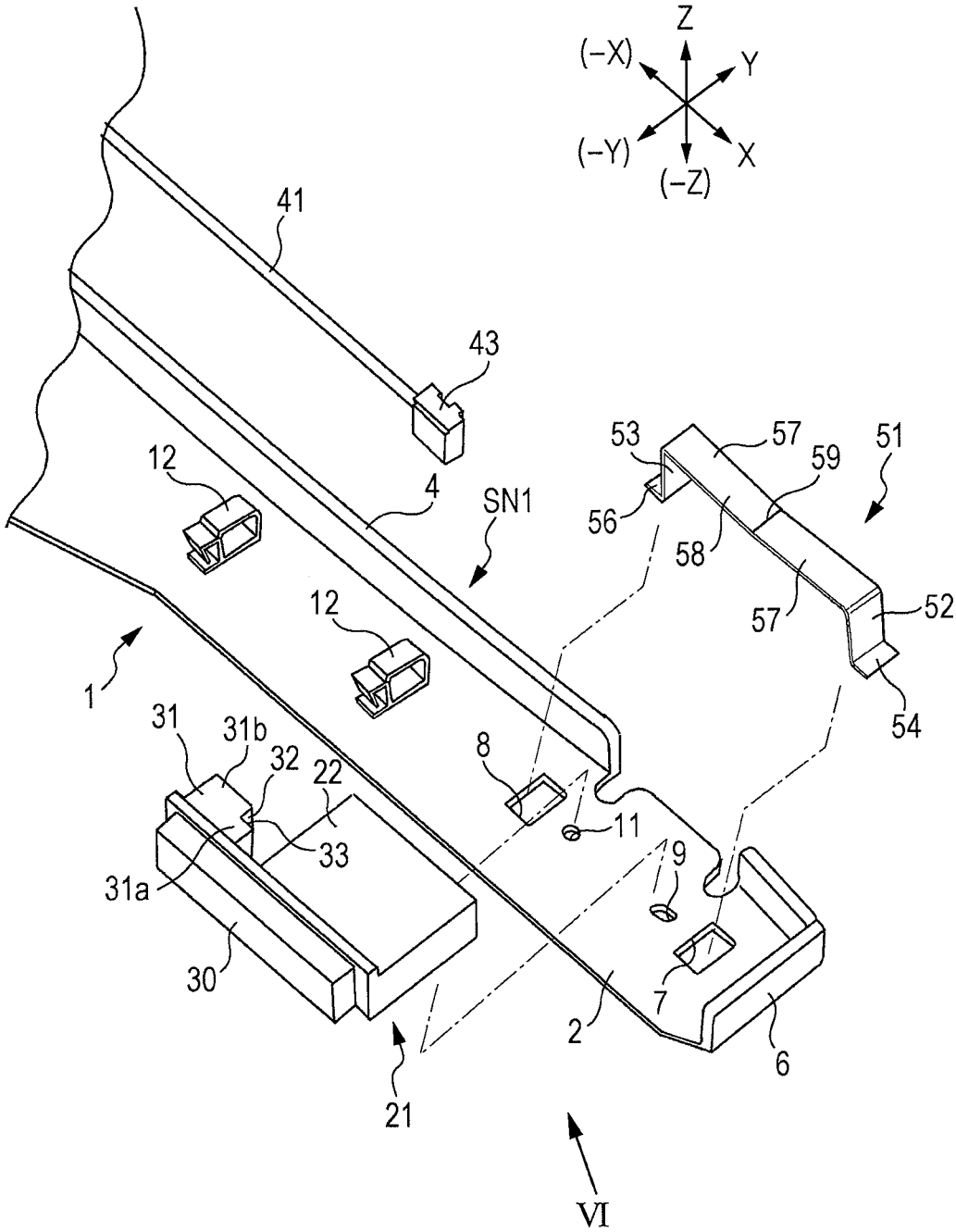
FIG. 4 is an exploded view of the detection member according to the first exemplary embodiment of the invention.

FIG. 2 is a perspective view of a detection member according to a first exemplary embodiment of the invention. FIG. 3 illustrates the components of the detection member according to the first exemplary embodiment of the invention. FIG. 4 is an exploded view of the detection member according to the first exemplary embodiment of the invention. As illustrated in FIG. 1, the density sensor unit SN1 is disposed beneath the development unit G. As illustrated in FIGS. 2 to 4, the density sensor unit SN1 according to the first exemplary embodiment includes a bracket 1 extending in the front-rear direction. The bracket 1 is an example of a detection support member.

The bracket 1 further includes a flat base plate 2 extending in the front-rear direction. The base plate 2 is an example of the body of a support member. The base plate 2 has, at the rear end thereof, a flat plate 3 to be fixed. The plate 3 to be fixed extends upward from the rear end of the base plate 2. In addition, the plate 3 to be fixed extends in the right-left direction. The plate 3 to be fixed has portions 3*a* to be supported at the right end and the left end thereof. Each of the portions 3*a* to be supported is bent towards the rear side. Each of the portions 3*a* to be supported has a claw portion 3*b* formed at the rear end thereof and protruding downward. The claw portion 3*b* is an example of a positioning portion. The plate 3 to be fixed has two screw through-holes 3*c* formed therein on the inner sides of the two portions 3*a* to be supported. The screw through-hole 3*c* is an example of a fixed hole. The base plate 2 further has, at the right end thereof, a right wall 4 extending upward. The right wall 4 is an example of a right wall of the supporting unit. In addition, the base plate 2 has, at the front end thereof, a protection portion 6 bent upward and extending in the right-left direction. The protection portion 6 is an example of a separating member.

As illustrated in FIG. 4, the base plate 2 has a rectangular front fixing hole 7 formed therein at the front end thereof. The front fixing hole 7 extends in the right-left direction. The front fixing hole 7 is formed so as to be spaced apart from the protection portion 6 by a predetermined distance. The front fixing hole 7 serves as an opening. The front fixing hole 7 is an example of a first connected unit. The base plate 2 further has a rectangular rear fixing hole 8 formed therein behind the front fixing hole 7. The rear fixing hole 8 forms a pair with the front fixing hole 7. The rear fixing hole 8 extends in the right-left direction. The front fixing hole 7 serves as an opening. The rear fixing hole 8 is an example of a second connected unit. A sensor positioning slot 9 extending in the front-rear direction and a circular sensor positioning hole 11 are formed sequentially from the front between the front fixing holes 7 and the rear fixing hole 8. The sensor positioning slot 9 is an example of a second positioning unit, and the sensor positioning hole 11 is an example of a first positioning unit. In addition, three wiring clips 12 are sequentially disposed behind the rear fixing hole 8 at preset intervals. Each of the three wiring clips 12 is an example of a wiring holding unit.

Figure 5:
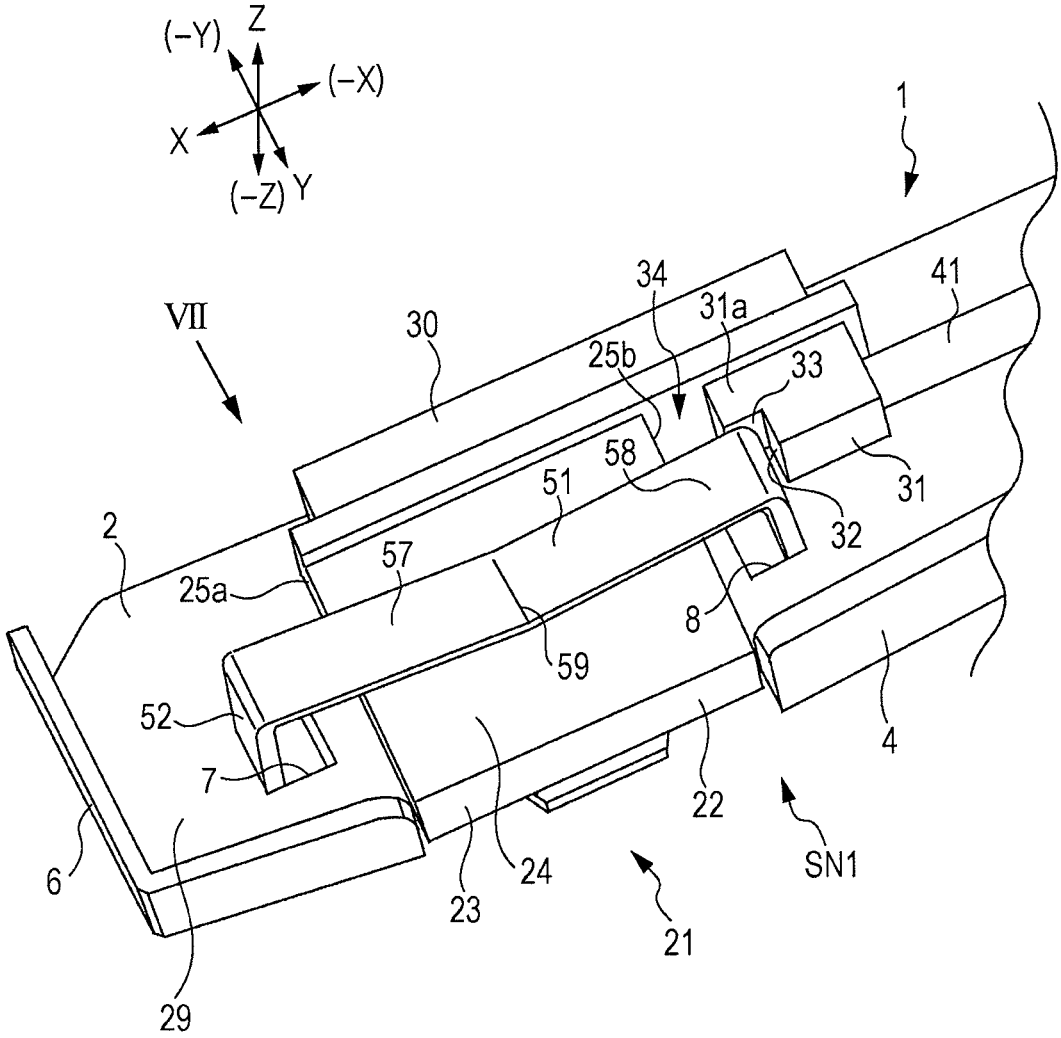
FIG. 5 is a view of the first exemplary embodiment of the invention viewed in the direction indicated by an arrow V illustrated in FIG. 3.
Figure 6:
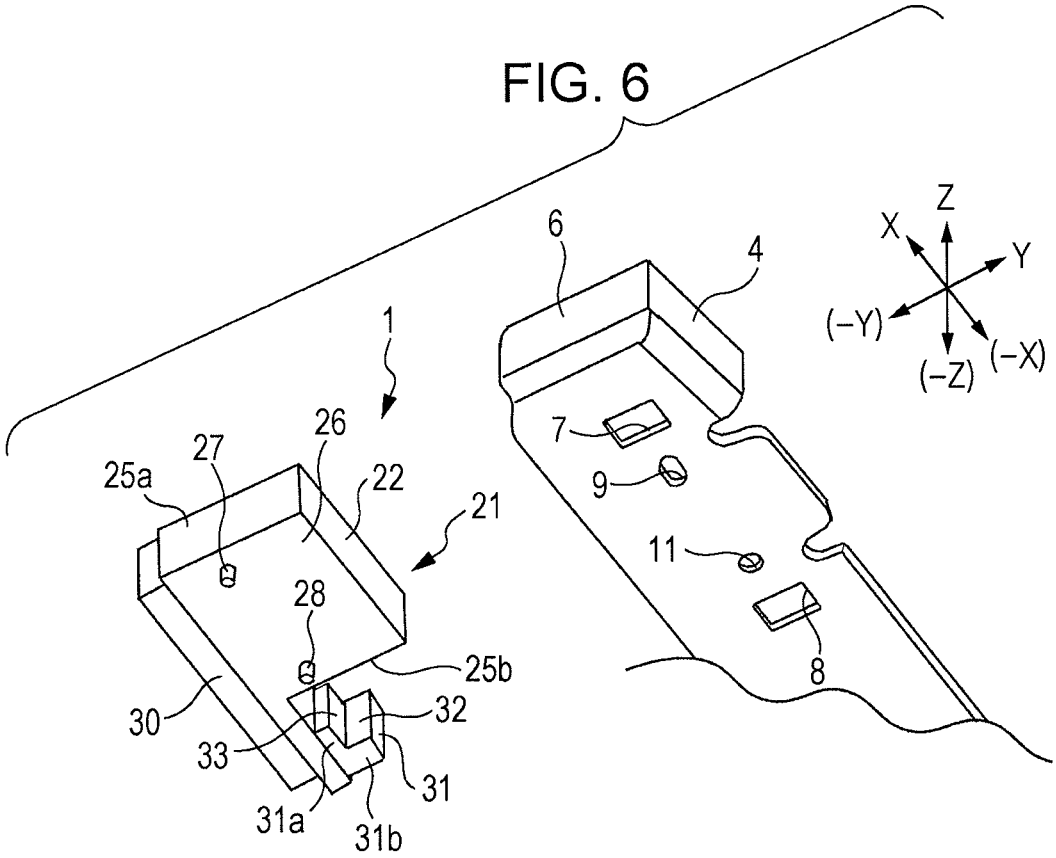
FIG. 6 is a view of the first exemplary embodiment of the invention viewed in the direction indicated by an arrow VI illustrated in FIG. 4.

FIG. 5 is a view of the first exemplary embodiment of the invention viewed in the direction indicated by an arrow V illustrated in FIG. 3. FIG. 6 is a view of the first exemplary embodiment of the invention viewed in the direction indicated by an arrow VI illustrated in FIG. 4. As illustrated in FIGS. 3 and 5, a density sensor 21 is disposed in the front end portion of the base plate 2 so as to face the sensor positioning slot 9 and the circular sensor positioning hole 11. The density sensor 21 is an example of a detecting unit. As illustrated in FIGS. 3 to 6, the density sensor 21 includes a density sensor body 22 having a rectangular parallelepiped shape extending in the front-rear direction. The density sensor body 22 includes a detecting unit 23 that faces the photorecepter drum PR, a sensor upper surface 24 extending in the front-rear direction, a sensor front surface 25*a* extending in the up-down direction, a sensor rear surface 25*b* extending in the up-down direction, and a sensor lower surface 26 that is opposite to the sensor upper surface 24 and that extends in the front-rear direction. The detecting unit 23 detects the density of an image formed on the surface of the photorecepter drum PR. The sensor upper surface 24 is an example of the upper surface of the detecting unit and an example of a unit to be contacted. The sensor front surface 25*a* is an example of the front surface of the detecting unit, the sensor rear surface 25*b* is an example of the rear surface of the detecting unit, and the sensor lower surface 26 is an example of the lower surface of the detecting unit.

As illustrated in FIG. 6, the sensor lower surface 26 has, at a position facing the sensor positioning slot 9, a columnar front positioning pin 27 that protrudes downward and is insertable into the sensor positioning slot 9. The front positioning pin 27 is an example of a second positioning unit. In addition, the sensor lower surface 26 has, at a position facing the circular sensor positioning hole 11, a columnar rear positioning pin 28 that protrudes downward and is insertable into the sensor positioning hole 11. The rear positioning pin 28 is an example of a first positioning unit. Accordingly, the rear positioning pin 28 is inserted into the sensor positioning hole 11 so that the rear portion of the density sensor 21 is properly positioned. In addition, the front positioning pin 27 is inserted into the sensor positioning slot 9 so that the front portion of the density sensor 21 is properly positioned in the right-left direction. In this way, the density sensor 21 is supported by the bracket 1. Furthermore, a front gap 29 is formed in front of the sensor front surface 25*a* of the density sensor body 22. The front gap 29 is formed between the sensor front surface 25*a* and the protection portion 6. The front fixing hole 7 is located at the bottom end of the front gap 29.

Figure 7:
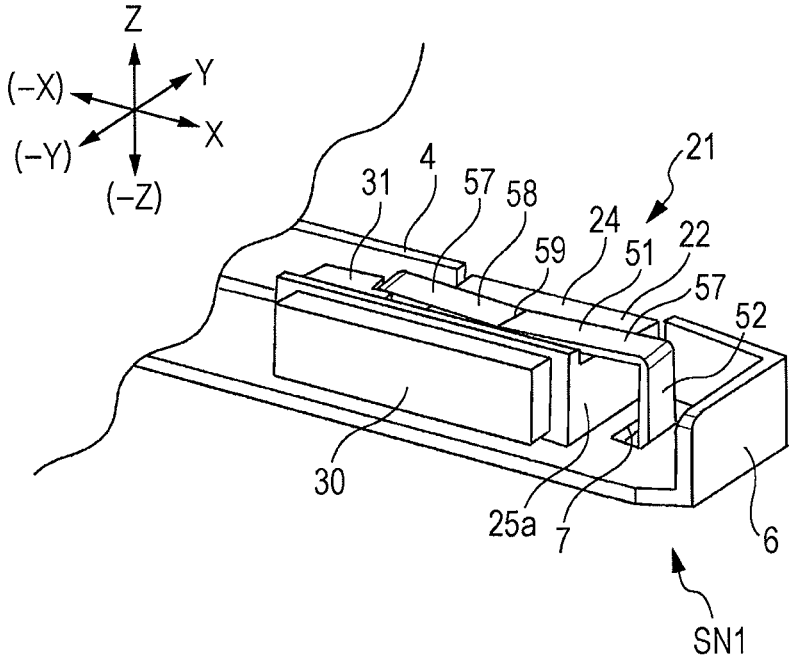
FIG. 7 is a view of the first exemplary embodiment of the invention viewed in the direction indicated by an arrow VII illustrated in FIG. 5.

FIG. 7 is a view of the first exemplary embodiment of the invention viewed in the direction indicated by an arrow VII illustrated in FIG. 5. As illustrated in FIGS. 3 to 7, a sensor control board 30 extending in the rear direction is supported by the density sensor body 22 at the left end of the density sensor body 22. The sensor control board 30 is an example of a connection arm unit. A connector 31 extending rightward is supported by the sensor control board 30 at the rear end of the sensor control board 30. The connector 31 is an example of a disengagement restricting unit and an example of a terminal unit. The sensor control board 30 is electrically connected to the density sensor body 22 and the connector 31. According to the first exemplary embodiment, the connector 31 includes a connector left portion 31*a* supported by the sensor control board 30 and a connector right portion 31*b* that is shorter than the connector left portion 31*a* in the front-rear direction. Note that according to the first exemplary embodiment, the connector 31 is disposed behind the rear fixing hole 8 with the density sensor 21 supported by the bracket 1. A fixation support surface 32 extending in the up-down direction is formed at the front of the connector right portion 31*b* at a position corresponding to the rear edge of the rear fixing hole 8. In addition, a slant prevention surface 33 extending forward from the left end of the fixation support surface 32 is formed as the right surface of the connector left portion 31*a* so as to correspond to the left edge of the rear fixing hole 8. Furthermore, a rear gap 34 is formed in front of the fixation support surface 32 and on the right of the slant prevention surface 33 so as to be surrounded by the fixation support surface 32, the slant prevention surface 33, and the sensor rear surface 25*b* of the density sensor body 22. The rear fixing hole 8 is located at the bottom end of the rear gap 34.

In addition, the rear surface of the connector 31 has an opening (not illustrated) formed therein. A detection connector 43 provided at one end of a cable 41 is releasably connected to the connector 31. The detection connector 43 is an example of a terminal for detection, and the cable 41 is an example of an interconnection line. The other end of the cable 41 has a connector 44 for a copying machine (not illustrated). The connector 44 is an example of an image forming apparatus body terminal that is connectable to a connection terminal provided on the copying machine. Therefore, according to the first exemplary embodiment, the density sensor 21 is electrically connected to the copying machine body U1 via the cable 41. Thus, the density sensor 21 can transmit the detected image density value to the copying machine body U1. In addition, the density sensor 21 can receive electrical power from the copying machine body U1.

Figure 8:
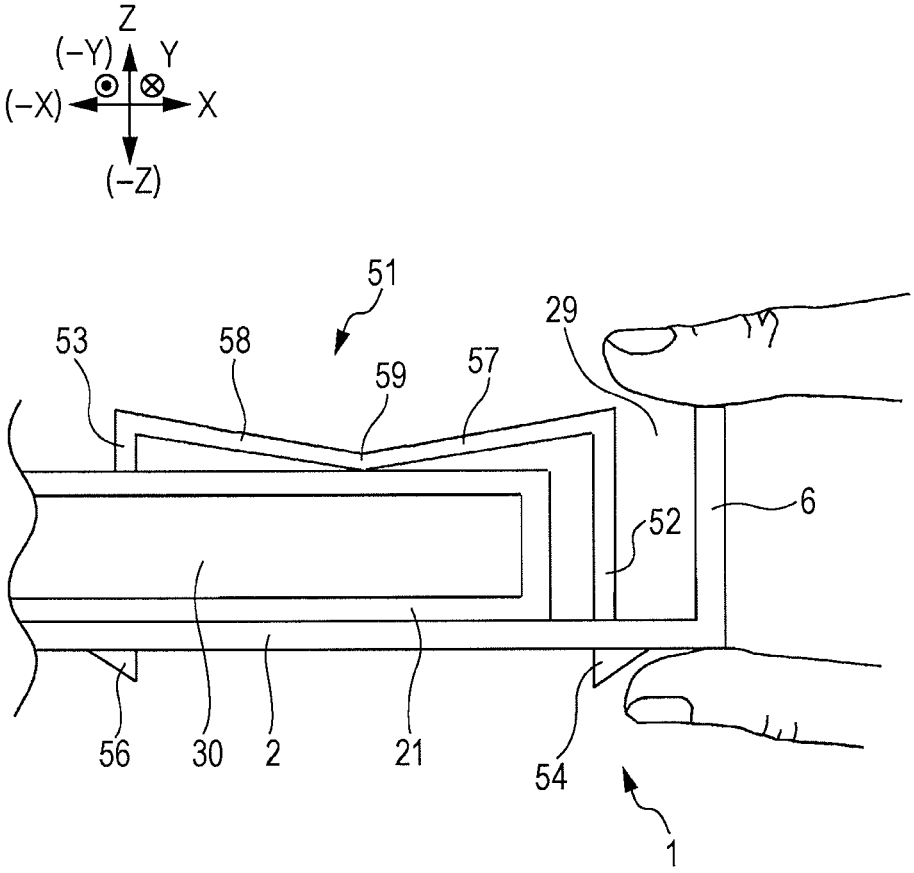
FIG. 8 illustrates the components of the detecting unit supported by a supporting unit viewed from the left, according to the first exemplary embodiment of the invention.

FIG. 8 illustrates the detecting unit supported by the supporting unit viewed from the left, according to the first exemplary embodiment of the invention. As illustrated in FIGS. 3 to 5 and FIG. 7, a fixing clip 51 is disposed above the density sensor body 22. The fixing clip 51 is an example of a fixing member. The fixing clip 51 includes a front leg portion 52 and a rear leg portion 53 that extends in the up-down direction at positions corresponding to the front fixing hole 7 and the rear fixing hole 8 so that the front leg portion 52 and the rear leg portion 53 are insertable into the front fixing hole 7 and the rear fixing hole 8 from above, respectively. The front leg portion 52 is an example of a first connecting unit, and the rear leg portion 53 is an example of a second connecting unit. The front leg portion 52 and the rear leg portion 53 have a front hook claw 54 and a rear hook claw 56 at the lower ends thereof, respectively. The hook claws 54 and 56 are bent toward the outer edge of the fixing hole 7 and the outer edge of the fixing hole 8 in the front-rear direction, respectively. The front hook claw 54 is an example of a front connection hook unit, and the rear hook claw 56 is an example of a rear connection hook unit. According to the first exemplary embodiment, the hook claws 54 and 56 are hooked on the outer edges of the fixing holes 7 and 8 with the leg portions 52 and 53 being placed in the fixing holes 7 and 8, respectively. Thus, the leg portions 52 and 53 are prevented from coming out of the fixing holes 7 and 8, respectively.

Note that the lengths of the leg portions 52 and 53 in the up-down direction are set so as to be longer than the height of the density sensor body 22. In addition, the leg portions 52 and 53 have a front slant portion 57 and a rear slant portion 58 extending from the tops thereof to the sensor upper surface 24 in the inward downward diagonal direction, respectively. The front slant portion 57 is an example of a first pressure connecting portion, and the rear slant portion 58 is an example of a second pressure connecting portion. The lower ends of the slant portions 57 and 58 are joined together by a pressing unit 59. The distance between the pressing unit 59 and the hook claw 54 or the distance between the pressing units 59 and 56 in the up-down direction is set so as to be less than the distance between the sensor upper surface 24 and the sensor lower surface 26 of the density sensor body 22 in the up-down direction. According to the first exemplary embodiment, the components of the fixing clip 51 (i.e., the front leg portion 52 to the pressing unit 59) are made of plastic and are integrated with each other so as to be elastically deformable. Therefore, in the fixing clip 51 according to the first exemplary embodiment, the leg portions 52 and 53 are inserted into the front fixing holes 7 and 8 from above, and the pressing unit 59 is in contact with the sensor upper surface 24 with the hook claws 54 and 56 hooked on the outer edges of the fixing holes 7 and 8 in order to prevent the leg portions 52 and 53 from coming out of the fixing holes 7 and 8, respectively. Accordingly, the pressing unit 59 is urged upward by the sensor upper surface 24 and, therefore, the fixing clip 51 is elastically deformed. At that time, an elastic restoring force acts on the pressing unit 59. The pressing unit 59 urges the sensor upper surface 24 downward. Thus, the density sensor body 22 is urged to the base plate 2 by the pressing unit 59. In this way, the density sensor body 22 is fixed to the base plate 2.

Figure 9:
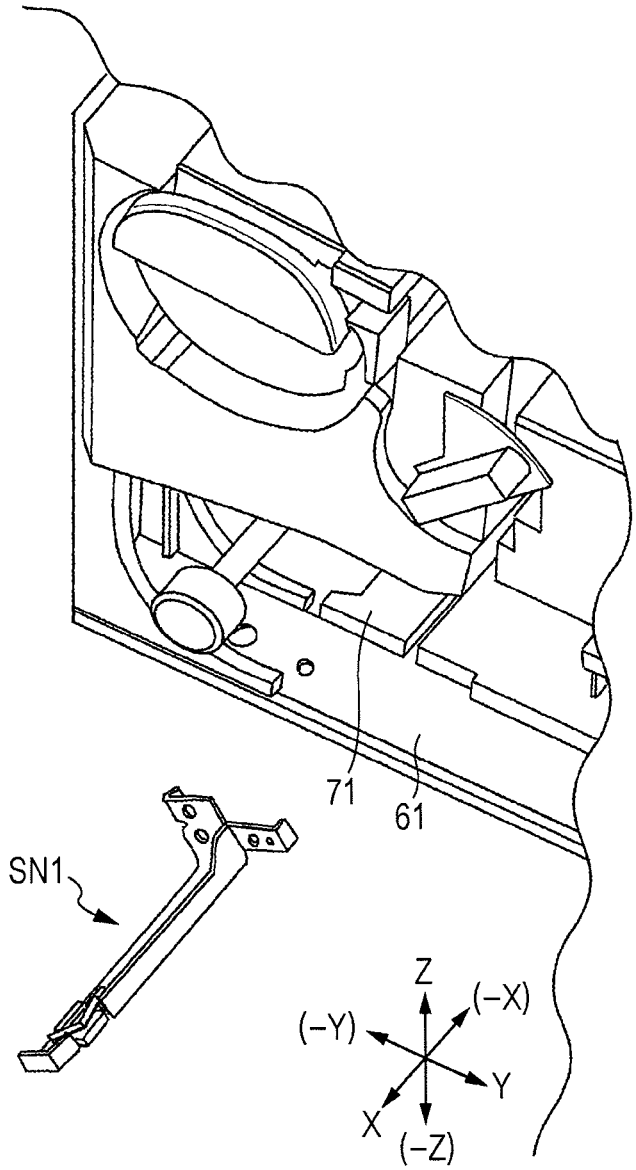
FIG. 9 is a perspective view of the body of the image forming apparatus having an openable and closable member that is open according to the first exemplary embodiment of the invention.
Figure 10:
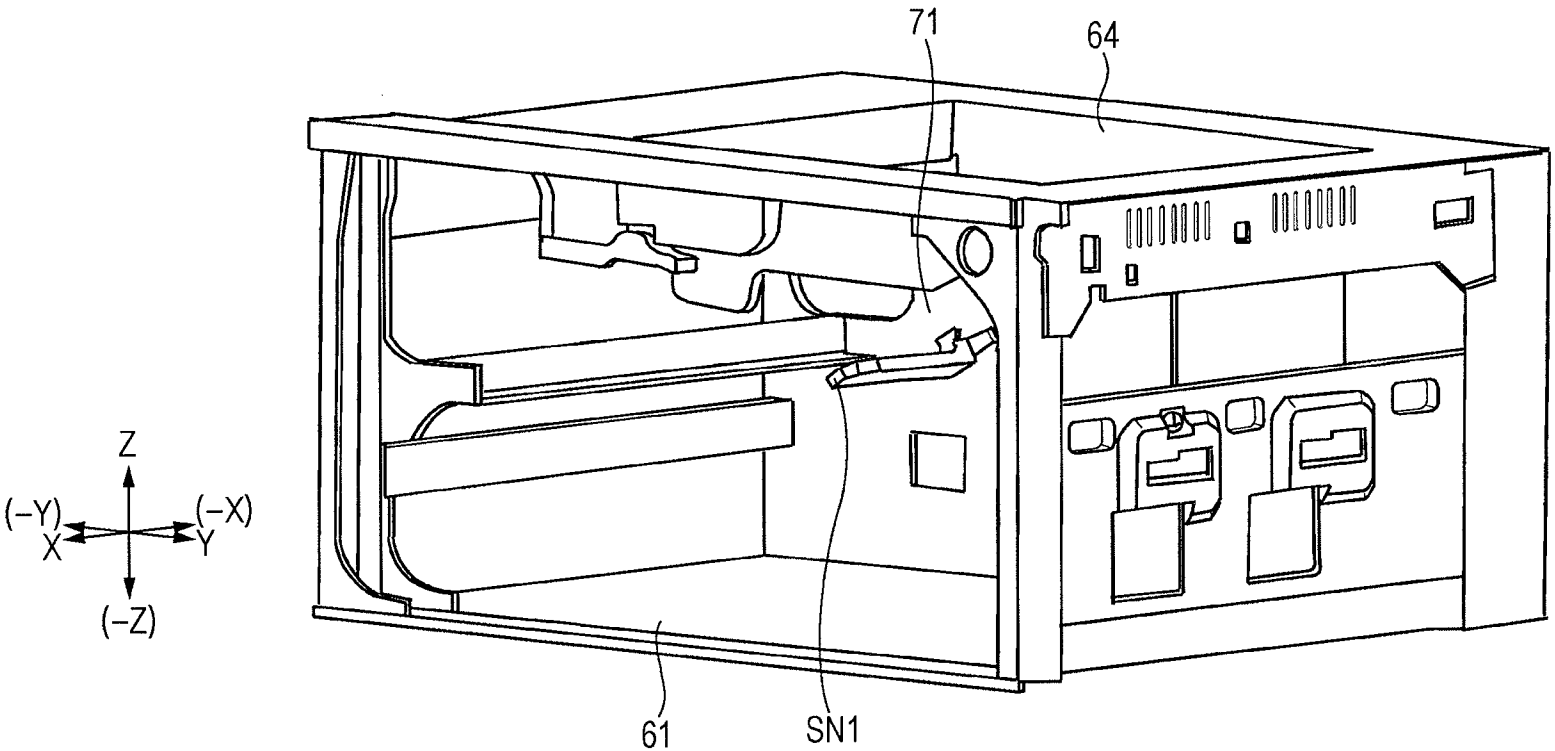
FIG. 10 illustrates the components of the image forming apparatus having an image density detection member attached thereto according to the first exemplary embodiment of the invention.
Figure 11:
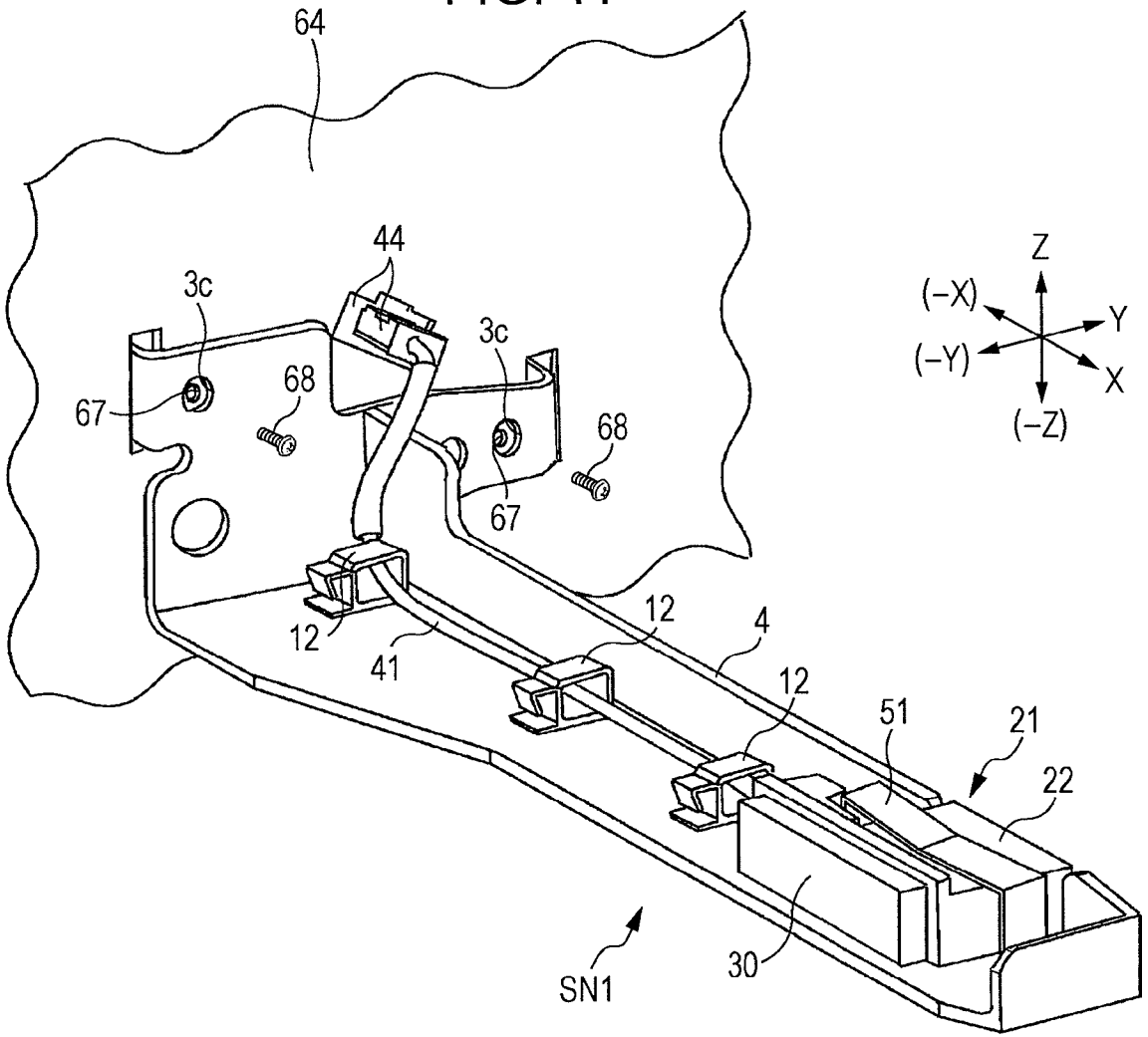
FIG. 11 is an enlarged perspective view of a frame member of the body having an image density detection member attached thereto according to the first exemplary embodiment of the invention.
Figure 12:
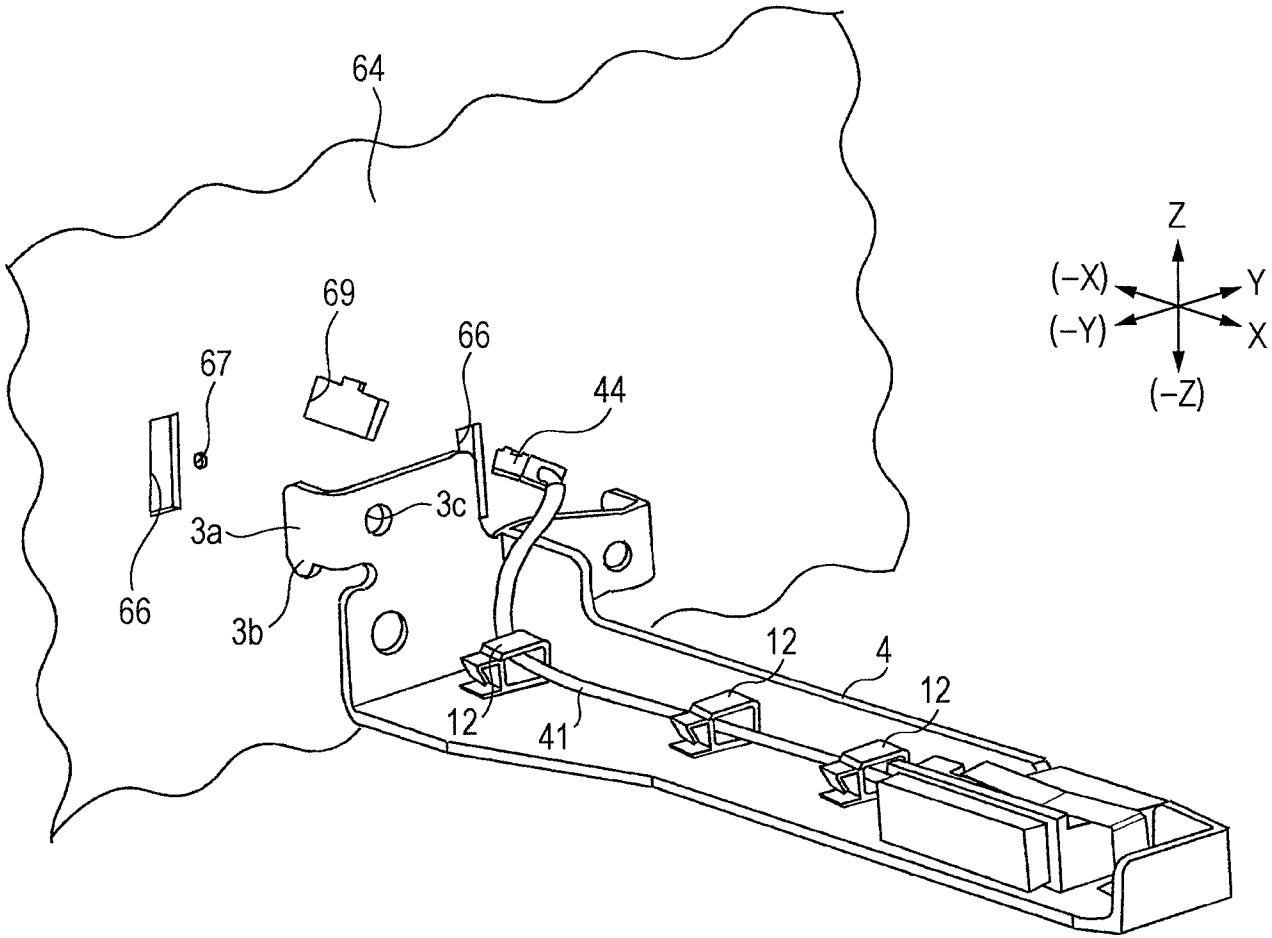
FIG. 12 is an enlarged perspective view of the frame member of the body after the image density detection member attached thereto is removed according to the first exemplary embodiment of the invention.

FIG. 9 is a perspective view of the body of the image forming apparatus having an openable and closable member that is open according to the first exemplary embodiment of the invention. FIG. 10 illustrates the components of the image forming apparatus having an image density detection member attached thereto according to the first exemplary embodiment of the invention. FIG. 11 is an enlarged perspective view of a frame member of the body having an image density detection member attached thereto according to the first exemplary embodiment of the invention. FIG. 12 is an enlarged perspective view of the frame member of the body after the image density detection member attached thereto is removed according to the first exemplary embodiment of the invention. The copying machine body U1 has a removable front covering (not illustrated), which is an example of the openable and closable member, as the front surface thereof. As illustrated in FIG. 9, a mounting port 61 for mounting or removing the development unit G and the density sensor unit SN1 is provided in the front surface of the copying machine body U1. As illustrated in FIGS. 9 to 12, a body frame 64 of the copying machine body U1 is disposed behind the mounting port 61. The body frame 64 has a plate-like shape extending in the up-down direction. The body frame 64 is an example of a frame member of the body of the image forming apparatus.

As illustrated in FIGS. 11 and 12, the body frame 64 has two unit supporting ports 66 each having a rectangular opening shape. The unit supporting ports 66 are an example of a unit supporting portion. The two unit supporting ports 66 are located so as to correspond to the two portions 3*a* to be supported. In addition, as illustrated in FIG. 11, the portions 3*a* to be supported pass through the unit supporting ports 66, and the two claw portions 3*b* are hooked on the outer edges of the unit supporting ports 66. In this way, the density sensor unit SN1 is prevented from coming forward out of the body frame 64, and the rear end of the density sensor unit SN1 is supported in cantilever fashion. Furthermore, the body frame 64 has two unit-fixing screw holes 67 formed therein at positions inside of the unit supporting ports 66. The two unit fixing screw holes 67 are located so as to correspond to the two screw through-holes 3*c*. As illustrated in FIG. 11, two unit fixing screws 68, which are examples of join fixing members that pass through the two screw through-holes 3*c*, are threadably mounted in the two unit fixing screw holes 67. Thus, the density sensor unit SN1 is removably fixed to the body frame 64.

The body frame 64 has a cable port 69 formed therein between the two unit supporting ports 66. The cable port 69 extends in the right-left direction so as to correspond to the cable 41. The cable port 69 is an example of an opening for a connection member. As illustrated in FIG. 11, the cable 41 extends through the cable port 69, and the connector 44 is connected to a connection terminal of a copying machine body (not illustrated). In addition, a sensor containing space 71 that is formed beneath the development unit G and that extends in the front-rear direction is formed between the mounting port 61 and the body frame 64. The sensor containing space 71 is an example of an internal space. The density sensor unit SN1 fixed to the body frame 64 is contained in the sensor containing space 71.

Operation of First Exemplary Embodiment

According to the first exemplary embodiment, in the copying machine U having the above-described configuration, the density sensor unit SN1 detects a density control image formed on the surface of the photorecepter drum PR at a predetermined point in time (e.g., the time when the copying machine U is powered on or the time when a job is started). Thereafter, the voltages applied to the charging roller CR and the development roller R0 of the development unit G are controlled and the intensity of the laser beam L is controlled in accordance with the image density detected by the density sensor unit SN1. That is, so-called process control is performed.

Figure 13A:
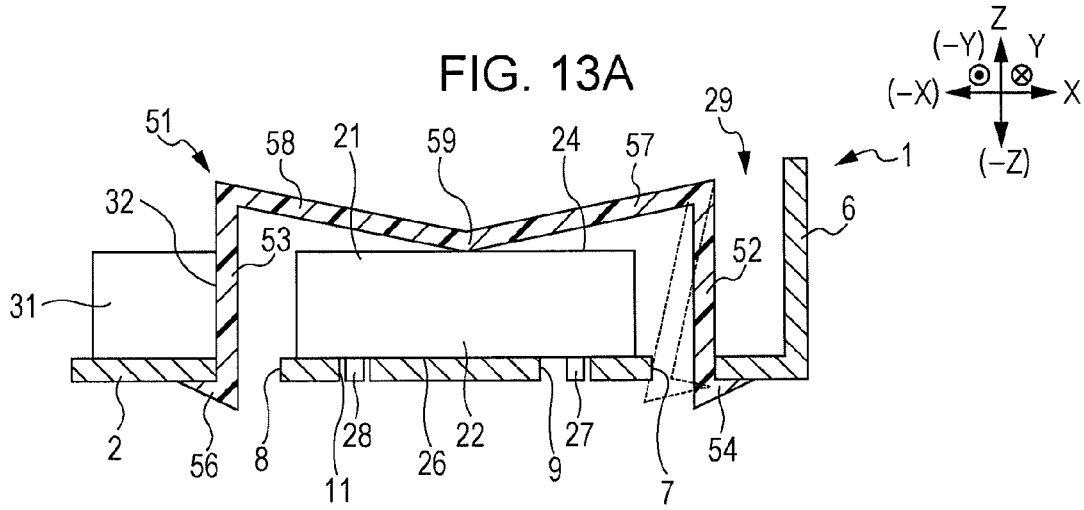
FIG. 13A is a cross-sectional view of the components viewed when a first connecting unit hooked on a first unit to be connected is released.
Figure 13B:
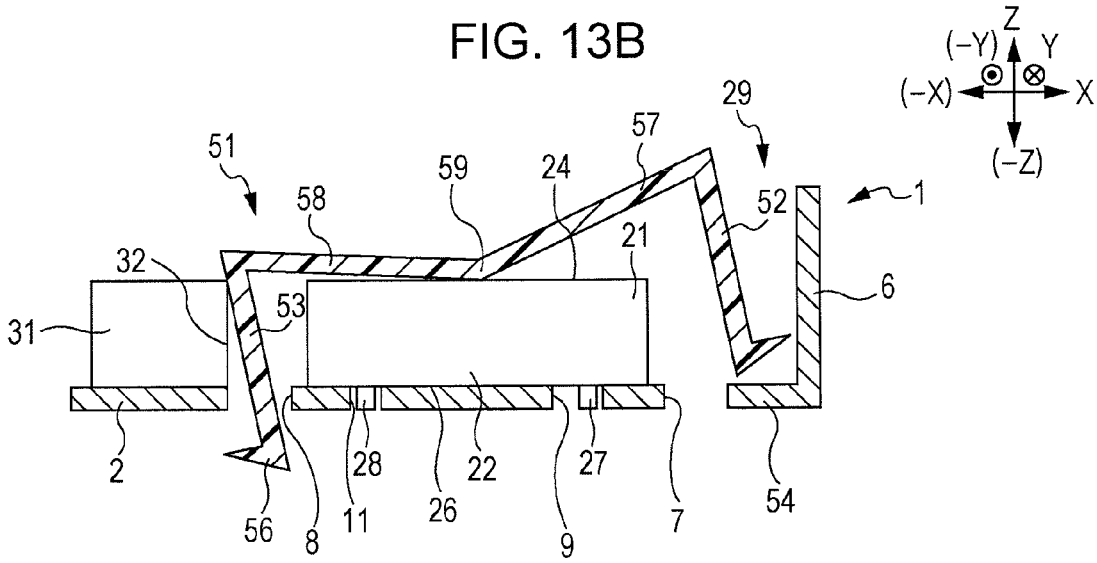
FIG. 13B is a cross-sectional view of the components viewed when a second connecting unit hooked on a second unit to be connected is released.

FIGS. 13A and 13*b* are cross-sectional views of the components viewed when a connection unit that hooks on the connected unit according to the first exemplary embodiment of the invention. More specifically, FIG. 13A is a cross-sectional view viewed when a first connecting unit hooked on a first connected unit is released. FIG. 13B is a cross-sectional view viewed when a second connecting unit hooked on a second connected unit is released. According to the first exemplary embodiment, in the density sensor unit SN1 removably supported by the copying machine body U1, the density sensor 21 is supported by the bracket 1. As illustrated in FIGS. 13A and 13B, when the density sensor 21 is mounted on the bracket 1, the rear positioning pin 28 and the front positioning pin 27 formed on the sensor lower surface 26 are inserted into the sensor positioning slot 9 and the sensor positioning hole 11 of the bracket 1, respectively. Thus, the density sensor 21 is properly positioned on the bracket 1. Thereafter, the rear leg portion 53 of the fixing clip 51, which is formed of an elastically deformable plastic, is inserted into the rear fixing hole 8 from the side of the density sensor body 22, and the hook claw 56 is hooked on the rear edge of the rear fixing hole 8. Subsequently, the front leg portion 52 is inserted into the front fixing hole 7, and the hook claw 54 is hooked on the front edge of the front fixing hole 7. Thus, the density sensor 21 is sandwiched by the fixing clip 51 and the bracket 1.

At that time, according to the first exemplary embodiment, the fixation support surface 32 of the connector 31 is placed so as to correspond to the rear edge of the rear fixing hole 8. Accordingly, the distance between the protection portion 6 and the front fixing hole 7 is larger than the rear gap 34 formed between the fixation support surface 32 and the rear fixing hole 8. Therefore, an operator can easily insert their finger and perform his/her operation. Consequently, the operation for hooking the hook claw 54 on the front fixing hole 7 after inserting the rear leg portion 53 into a narrow gap formed between the sensor rear surface 25*b* and the connector 31 and hooking the hook claw 56 on the rear fixing hole 8 is easier than an operation for hooking the hook claw 56 on the rear fixing hole 8 after hooking the hook claw 54 on the front fixing hole 7 or an operation for hooking the hook claws 54 and 56 on the fixing holes 7 and 8 at the same time. Thus, in order to mount the density sensor 21 on the bracket 1, the operation in which the rear leg portion 53 is mounted first has a higher workability.

According to the first exemplary embodiment, in the fixing clip 51, the distance between the position of the pressing unit 59, which is joined to the top end of each of the leg portions 52 and 53 via the slant portions 57 and 58, respectively, and the position of the front hook claw 54 and the rear hook claw 56 in the up-down direction is set so as to be smaller than the distance between the sensor upper surface 24 and the sensor lower surface 26. Accordingly, when the hook claws 54 and 56 are hooked on the fixing holes 7 and 8, respectively, the pressing unit 59 is in contact with the sensor upper surface 24 and, therefore, is urged upward. Thus, the fixing clip 51 is elastically deformed. At that time, an elastic restoring force of the deformed fixing clip 51 acts on the sensor upper surface 24. That is, the pressing unit 59 presses the sensor upper surface 24 downward. Thus, the density sensor 21 is fixed to the bracket 1 by the pressing force applied to the density sensor 21 toward the bracket 1. In this way, the fixing clip 51 is attached to the bracket 1, and the density sensor unit SN1 having the density sensor 21 fixed to the density sensor 21 is assembled.

As illustrated in FIG. 9, in order to mount the density sensor unit SN1 according to the first exemplary embodiment on the copying machine body U1, the operator holds the front end of the density sensor unit SN1 and inserts the density sensor unit SN1 through the mounting port 61 of the copying machine body U1 toward the back of the copying machine body U1 (in the rear direction). Thereafter, as illustrated in FIGS. 11 and 12, after the portions 3*a* to be supported at the rear end of the density sensor unit SN1 are inserted into the unit supporting ports 66 of the body frame 64, the portions 3*a* to be supported are moved downward. Thus, the two claw portions 3*b* are hooked on the outer edges of the two unit supporting ports 66. Accordingly, the density sensor unit SN1 is prevented from coming forward out of the copying machine body U1. In addition, the rear end of the density sensor unit SN1 is supported in a cantilever fashion. Thereafter, the two unit fixing screws 68 that have passed through the two screw through-holes 3*c* are threadably mounted in the two unit fixing screw holes 67. In this way, the density sensor unit SN1 is mounted in the copying machine body U1.

The density sensor unit SN1 may be replaced with a new one due to aging degradation, malfunction, overhaul cleaning, or overhaul inspection. In such a case, the two unit fixing screws 68 of the density sensor unit SN1 to be replaced are removed first. Subsequently, the operator holds the front end of the density sensor unit SN1 and moves the density sensor unit SN1 upward. In this way, the two claw portions 3*b* are released from the two unit supporting ports 66. Thereafter, the density sensor unit SN1 is pulled out forward and, therefore, the portions 3*a* to be supported are pulled out forward from the unit supporting ports 66. In this way, the density sensor unit SN1 is removed through the mounting port 61 formed in the front surface of the copying machine body U1.

In addition, as illustrated in FIGS. 13A and 13B, in order to remove the density sensor 21 from the bracket 1 of the first exemplary embodiment, one finger of the operator is inserted into the front gap 29 formed between the front leg portion 52 and the protection portion 6, and the lower part of the front leg portion 52 is pushed backward. Thus, as illustrated by the solid line and the dotted line in FIG. 13A, the lower part of the leg portion 52 is elastically deformed backward. Therefore, the hook claw 54 is released from the front fixing hole 7. At that time, according to the first exemplary embodiment, the spacing of the front gap 29 formed between the front leg portion 52 and the protection portion 6 is set so that one finger is insertable without any margin when the operator removes the fixing clip 51. Accordingly, the operator can insert his/her finger into the front gap 29 from above, and the operator can easily press the lower part of the front leg portion 52.

That is, according to the first exemplary embodiment, the spacing of the front gap 29 is set so that one finger is insertable without any margin. In addition, the height of the protection portion 6 is set so as to be substantially the same as the height of the front leg portion 52. According to the first exemplary embodiment, in order to remove the density sensor unit SN1 from the copying machine body U1, the operator attempts to feel for the density sensor unit SN1 and hold the density sensor unit SN1, as illustrated in FIG. 8. At that time, the finger rarely touches the fixing clip 51 due to the presence of the protection portion 6. Even when the finger touches the fixing clip 51, the finger is likely to touch only the upper front end of the front leg portion 52. Note that in order to protect the finger from touching the upper front end of the front leg portion 52, the height of the protection portion 6 may be increased. However, in such a case, when one finger is inserted into a space formed between the protection portion 6 and the front leg portion 52 and if the fixing clip 51 is removed, the high protection portion 6 interferes with the insertion. Thus, the workability of removing the fixing clip 51 is disadvantageously decreased. Accordingly, it is desirable that the height of the protection portion 6 be substantially the same as the height of the front leg portion 52.

If the front hook claw 54 has a shape illustrated by the dotted line in FIG. 13A and is raised upward, the front leg portion 52 is pulled away from the front fixing hole 7. Subsequently, if, as illustrated in FIG. 13B, the fixing clip 51 having the released front leg portion 52 is moved forward, the rear hook claw 56 is released from the rear fixing hole 8. Then, if the rear leg portion 53 is pulled out upward, the fixing clip 51 that fixes the density sensor 21 to the bracket 1 is moved away. Accordingly, the density sensor 21 is not fixed to the bracket 1 anymore. Thus, the density sensor 21 can be moved away from the bracket 1. Subsequently, a new density sensor 21 is fixed to the bracket 1 in a manner that is the same as at an assembling time, and the bracket 1 is mounted on the copying machine body U1. In this way, replacement of the density sensor 21 is completed.

At that time, when the operator inserts his/her finger into the mounting port 61 in order to hold the protection portion 6 and mount the density sensor unit SN1 on or remove away from the copying machine body U1, the operator may happen to touch the fixing clip 51. When the finger touches the fixing clip 51, it is highly likely that the finger touches the upper front end of the fixing clip 51 due to the protection portion 6 that extends upward. In addition, in the density sensor unit SN1 according to the first exemplary embodiment, the fixation support surface 32 of the connector 31 is disposed so as to correspond to the rear edge of the rear fixing hole 8. Thus, as illustrated in FIGS. 3 and 13A, when the fixing clip 51 is mounted, the rear surface of the rear leg portion 53 is located so as to face the fixation support surface 32 in close proximity to the fixation support surface 32. In such a position, the hook claw 56 is hooked on the rear fixing hole 8.

Note that in a configuration of a related art, a sensor unit is fitted into a groove portion that extends along a guide unit. If the sensor unit is moved along the groove portion, the top end of a leaf spring supported by a sensor board in a cantilever fashion is urged against the bottom of the guide unit. In this way, the sensor unit is mounted on the guide unit. However, when, during an operation of mounting or removing the sensor board that supports the sensor unit, an operator attempts to feel for the sensor board to hold the sensor board and if the operator happens to touch the sensor unit, the operator may move the sensor unit in a direction away from the groove portion. If the sensor unit is moved in a direction away from the groove portion, the sensor unit receives a force from the guide unit due to an urging force applied from the leaf spring. Thus, the sensor unit may fall away from the guide unit.

Figure 14:
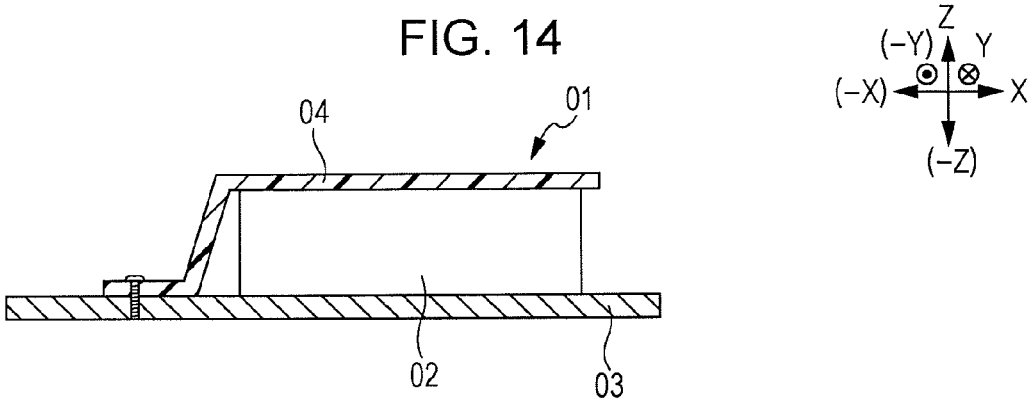
FIG. 14 illustrates the components of the configuration in which a detecting unit is fixed to a support member using an existing fixing member.

FIG. 14 illustrates a configuration in which a detecting unit is fixed to a support member using an existing fixing member. In addition, as illustrated in FIG. 14, in one of existing configurations, a leaf spring 04 that is in contact with an outer surface of a density sensor 02 of a sensor unit 01 and that urges the density sensor 02 against a bracket 03 in a cantilever fashion and fixes the density sensor 02 to the bracket 03 is employed in order to prevent a finger from directly touching the density sensor 02. However, in such a configuration, a metal material is widely used for the leaf spring 04 in order to apply a sufficient pressing force. Accordingly, the cost is often increased, as compared with a configuration in which a plastic material is used for the leaf spring 04. In addition, in this configuration, the leaf spring 04 is elastically deformed, and the density sensor 02 is urged against the bracket 03. Thus, the leaf spring 04 may wear over time and, therefore, the pressing force may be decreased. In such a case, the density sensor 02 may fall out of the bracket 03.

Furthermore, if one finger of the operator happens to touch the leaf spring 04 during a mount or dismount operation of the sensor unit 01, the pressing force of the leaf spring 04 may be released and, thus, the density sensor 02 may fall away from the bracket 03. Accordingly, in order to fix the density sensor to the bracket, a fixing clip that holds both ends of the density sensor can be used instead of a fixing clip that holds only one of the front end and the rear end of the density sensor in a cantilever fashion.

Figure 15A:
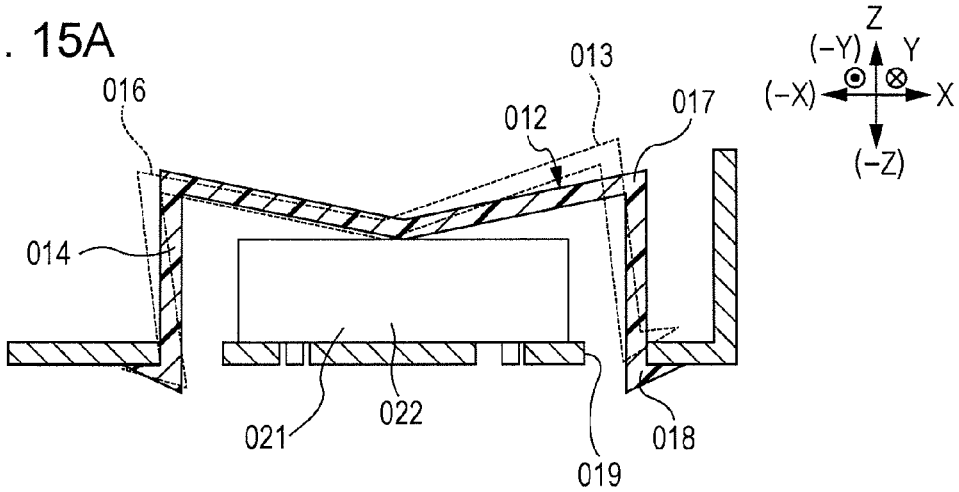
FIG. 15A illustrates a detection member that does not include a disengagement restricting unit.
Figure 15B:
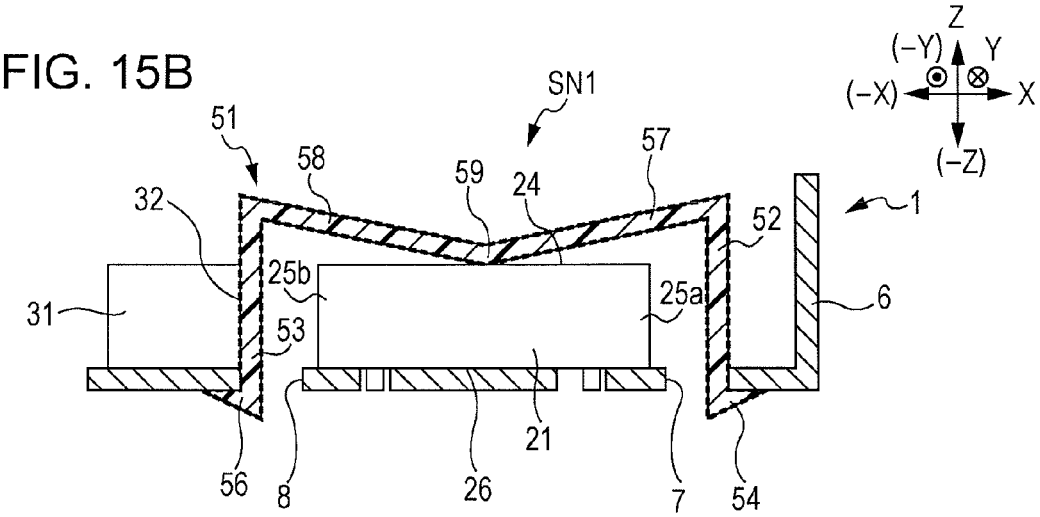
FIG. 15B illustrates a detection member according to the first exemplary embodiment of the invention.

FIGS. 15A and 15B illustrate a detection member that does not include a disengagement restricting unit and the detection member according to the first exemplary embodiment of the invention. More specifically, FIG. 15A illustrates a detection member that does not include a disengagement restricting unit, and FIG. 15B illustrates the detection member according to the first exemplary embodiment of the invention. As illustrated in FIG. 15A, when a fixing clip that holds both front and rear ends of the density sensor is used in a sensor unit 011 that does not have the fixation support surface 32 and if one finger happens to touch the upper front portion 013 of a clip 012 and the upper front portion 013 is pushed in the rear direction, the clip 012 is deformed from the shape illustrated as a solid line in FIG. 15A to the shape illustrated as a dotted line in FIG. 15A. That is, the upper front portion 013 is moved in the rear direction. In addition, an upper rear part 016 of a rear leg portion 014 is moved in the rear direction. At that time, in such a position, the front claw portion 018 of a front leg 017 receives a force that moves the front claw portion 018 in the rear direction. Thus, the front claw portion 018 is easily released from a front opening 019. Accordingly, during mount or dismount operation of the sensor unit 011, the clip 012 may fall away and, therefore, a density sensor 021 may fall away.

In contrast, according to the first exemplary embodiment, as illustrated in FIG. 15B, the fixation support surface 32 is provided so as to face the rear leg portion 53 in close proximity. If the upper front portion of the fixing clip 51 is pushed, the fixing clip 51 is deformed from the shape illustrated as a solid line in FIG. 15B to the shape illustrated as a dotted line in FIG. 15B. That is, in FIG. 15B, even when the rear leg portion 53 happens to be moved in the rear direction, the rear leg portion 53 is brought into contact with the fixation support surface 32. Thus, deformation of the rear leg portion 53 is restricted. Accordingly, the hook claw 56 is rarely released from the rear fixing hole 8 and, therefore, the rear leg portion 53 is rarely pulled away from the rear fixing hole 8. In addition, when deformation of the rear leg portion 53 is restricted by the fixation support surface 32 and if the upper front portion of the fixing clip 51 is pushed, the pressing unit 59 tends to deform in a direction in which the pressing unit 59 moves downward. However, since the pressing unit 59 is in contact with the sensor upper surface 24, downward movement of the pressing unit 59 is prevented. Accordingly, when the fixation support surface 32 prevents the rear leg portion 53 from moving, the deformation of the rear slant portion 58 is prevented.

Accordingly, as illustrated in FIG. 15B, a force that pushes the upper front portion of the fixing clip 51 acts on the front leg portion 52 and the front slant portion 57 as a force that rotates the fixing clip 51 about the pressing unit 59. Thus, the fixing clip 51 is deformed from the shape illustrated as a solid line in FIG. 15B into the shape illustrated as a dotted line in FIG. 15B. Accordingly, the front hook claw 54 receives a force in a direction in which the front hook claw 54 is moved obliquely forward and upward. That is, such a force that causes the hook claw 54 to dig into the edge of the front fixing hole 7 is exerted on the hook claw 54. Thus, the hook claw 54 is rarely released from the front fixing hole 7 and, therefore, the front leg portion 52 is rarely pulled away from the front fixing hole 7. Consequently, even when the upper front portion of the fixing clip 51 is pushed, the leg portions 52 and 53 are rarely pulled away from the fixing holes 7 and 8, respectively, and, therefore, the fixing clip 51 rarely falls off from the bracket 1, as compared with the case where the fixation support surface 32 is not provided.

As a result, in the configuration according to the first exemplary embodiment, a trouble of the density sensor 21 falling away during a mount or dismount operation of the density sensor unit SN1 due to release of the fixing clip 51 rarely occurs, as compared with the configuration of a related art and the configuration illustrated in FIG. 14 in which a leaf spring is used in a cantilever fashion, or a configuration illustrated in FIG. 15A in which the fixation support surface 32 is not provided. Accordingly, damage of the density sensor 21 during a mount or dismount operation of the density sensor unit SN1 rarely occurs. In addition, the workability of the mount or dismount operation of the density sensor unit SN1 can be increased. Furthermore, in the configuration of the fixing clip 51 according to the first exemplary embodiment, the pressing unit 59 is disposed so as to be closer to the sensor upper surface 24 than the top ends of the leg portions 52 and 53. When the upper front portion of the fixing clip 51 is pushed and if the deformation of the rear leg portion 53 is restricted by the fixation support surface 32, the pressing unit 59, which is connected to the rear leg portion 53 via the rear slant portion 58, tends to deform in a direction in which the pressing unit 59 moves downward. Accordingly, if the upper front portion of the fixing clip 51 is pushed, such a force that the pressing unit 59 urges the sensor upper surface 24 downward is exerted on the sensor upper surface 24 and, therefore, the density sensor 21 is urged against the bracket 1 in a direction opposite the direction in which the density sensor 21 falls away from the bracket 1. Thus, falling away of the density sensor 21 rarely occurs during a mount or dismount operation of the density sensor unit SN1, as compared with the case where the pressing unit 59 is not disposed so as to be closer to the sensor upper surface 24 than the top ends of the leg portions 52 and 53.

In addition, in the configuration according to the first exemplary embodiment, both ends of the density sensor 21 are held by the fixing clip 51. Accordingly, the density sensor 21 rarely falls away from the bracket 1, as compared with the configuration of a related art in which a leaf spring is used in a cantilever fashion. Therefore, a plastic material can be used as the material used for the fixing clip 51. By using a plastic material, an increase in the cost of the fixing clip 51 can be reduced and, therefore, the production cost can be reduced. In the configuration according to the first exemplary embodiment, the front surface of the connector 31, which is an element of the density sensor unit SN1 and is electrically connected to the density sensor 21, serves as the fixation support surface 32. That is, in the configuration according to the first exemplary embodiment, the number of components can be reduced by eliminating the need for a dedicated component providing the fixation support surface 32, as compared with the configuration in which part of the connector 31 is not used as the fixation support surface 32 and the dedicated component is provided. Thus, the production cost can be reduced.

Figure 16:
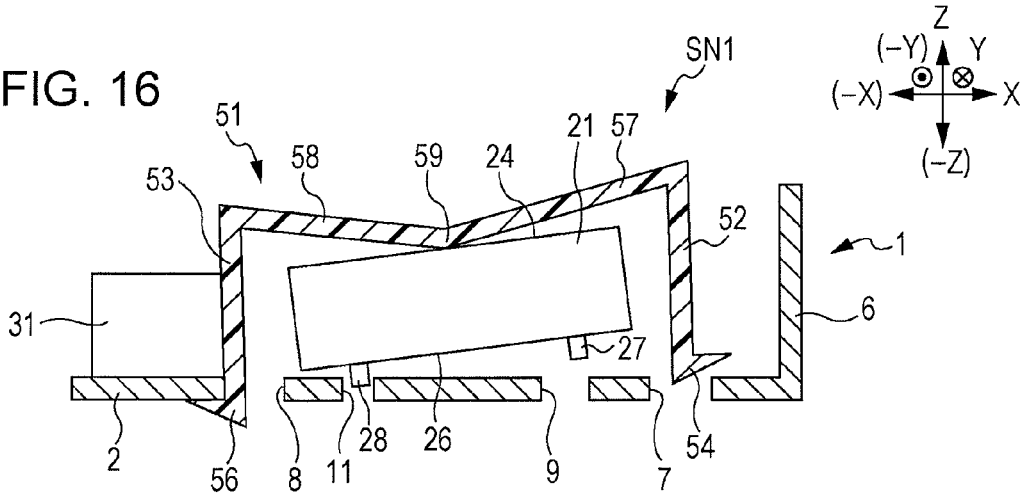
FIG. 16 illustrates dismount of the detecting unit from the support member with the second connecting unit being supported by the second connected unit.

FIG. 16 illustrates dismount of the detecting unit from the support member with the second connecting unit being supported by the second connected unit. When the fixing clip 51 is removed from the bracket 1 in order to replace the density sensor 21 with a new one due to aging degradation, malfunction, overhaul cleaning, or overhaul inspection, a risk of losing the fixing clip 51 arises. In order to reduce the risk of losing the fixing clip 51, the density sensor 21 may be mounted or dismounted with the front leg portion 52 removed from the front fixing hole 7, with the rear leg portion 53 in the rear fixing hole 8, and with the fixing clip 51 not completely removed from the bracket 1.

That is, in the configuration according to the first exemplary embodiment, the front leg portion 52 can be pulled out by rotating the front leg portion 52 upward about the hook claw 56 that is hooked on the rear fixing hole 8 as illustrated in FIG. 16 when the lower part of the front leg portion 52 is pushed and deformed as illustrated as the dotted line in FIG. 13A. Accordingly, the density sensor 21 can be mounted or dismounted by moving the density sensor 21 obliquely forward and upward with the fixing clip 51 not completely removed from the bracket 1. In the state illustrated in FIG. 16, the density sensor 21 is properly positioned using the sensor positioning slot 9, the sensor positioning hole 11, and the front positioning pins 27 and 28. In order to dismount the density sensor 21 obliquely forward and upward, the density sensor 21 is raised so that the front side of the density sensor 21 is inclined upward. Thus, the front positioning pin 27 is pulled out of the front sensor positioning slot 9. Thereafter, the rear positioning pin 28 is pulled out of the rear sensor positioning hole 11.

At that time, when the front positioning pin 27 is not a slot but a circular hole and if the front positioning pin 27 is fitted into the circular hole, it is difficult to incline the front side of the density sensor 21 upward even when an operator attempts to do so. Accordingly, even when an operator attempts to dismount the density sensor 21 with only the front leg portion 52 being released, it is difficult for the operator to move the density sensor 21 obliquely upward. Thus, the mount or dismount operation of the density sensor 21 is troublesome and, therefore, the workability is decreased. In contrast, in the configuration according to the first exemplary embodiment, the sensor positioning slot 9 is formed so as to have a slot shape extending in the front-rear direction on the front side. Accordingly, when the front positioning pin 27 is located inside of the sensor positioning slot 9, the front positioning pin 27 has a free space or a margin in the front-rear direction. Therefore, when the front surface of the density sensor 21 is inclined upward, the density sensor 21 is easily inclined by using the margin provided for the front positioning pin 27 located inside of the sensor positioning slot 9. Thus, in the configuration according to the first exemplary embodiment, the density sensor 21 can be easily mounted or dismounted, as compared with the configuration in which a circular hole is formed in the front side.

Figure 17:
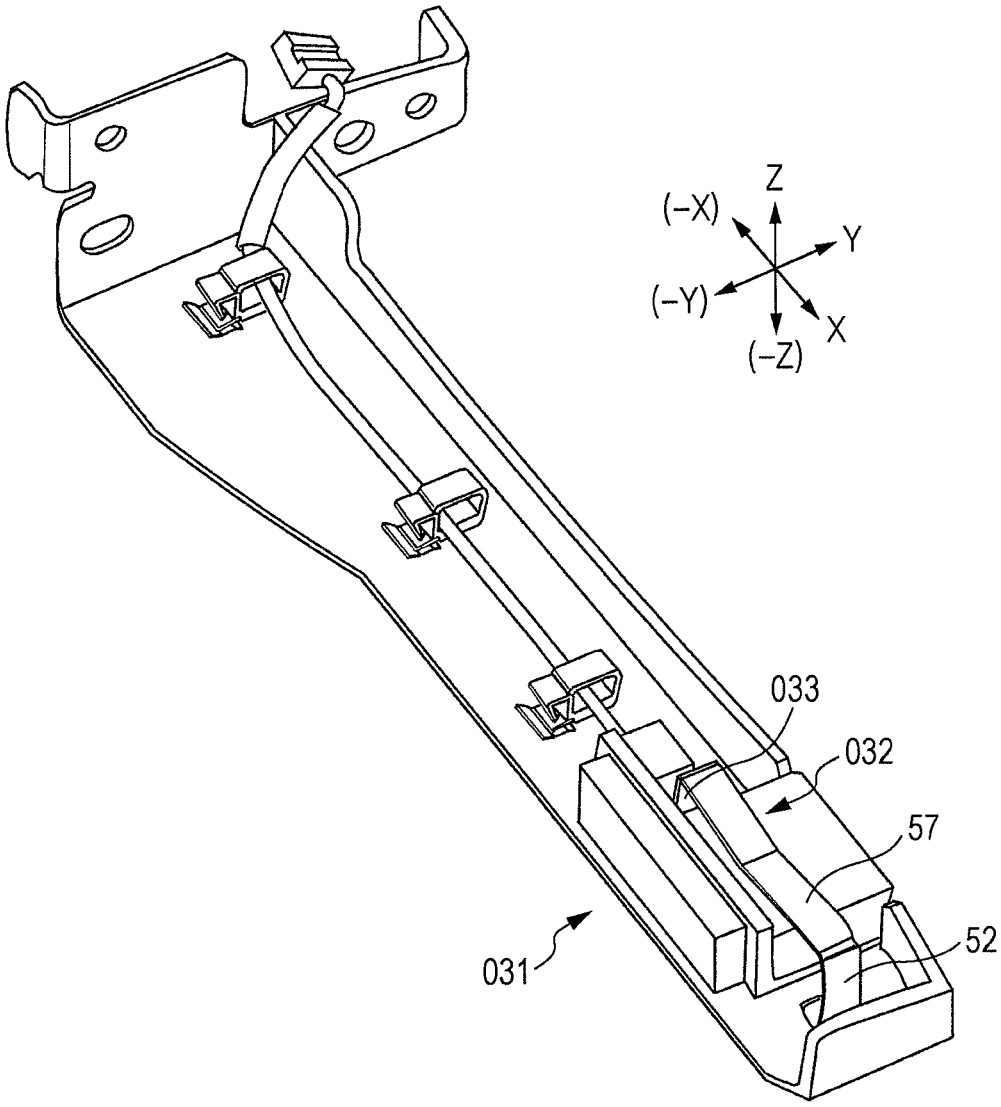
FIG. 17 illustrates a detection member that does not have a slant prevention surface.

FIG. 17 illustrates a detection member that does not have the slant prevention surface 33. In addition, in the density sensor unit SN1 according to the first exemplary embodiment, the slant prevention surface 33 that extends forward from the left end of the fixation support surface 32 is disposed so as to correspond to the left edge of the rear fixing hole 8. The rear leg portion 53 is disposed so as to face the fixation support surface 32 in close proximity in the rear direction and face the slant prevention surface 33 in close proximity in the left direction. Accordingly, when the rear leg portion 53 of the fixing clip 51 is mounted in the rear fixing hole 8 and if the rear leg portion 53 is inclined in the front-rear direction or in the right-left direction, the rear leg portion 53 is guided by the fixation support surface 32 or the slant prevention surface 33 that is in contact with the rear leg portion 53. In this way, the rear leg portion 53 is inserted into the rear fixing hole 8.

At that time, in the configuration of a sensor unit 031 that does not have the slant prevention surface 33 illustrated in FIG. 17, even when a rear leg portion 033 of a fixing clip 032 is inclined, the rear leg portion 033 is not brought into contact with the slant prevention surface 33 and, thus, the inclination is not corrected. Accordingly, the rear leg portion 033 is attempted to be mounted with the fixing clip 032 inclined. Consequently, it is difficult to insert the rear leg portion 033 into the hole and, therefore, the workability of mounting the fixing clip 032 is low. In contrast, in the configuration according to the first exemplary embodiment, the fixation support surface 32 and the slant prevention surface 33 are provided. Thus, inclination of the rear leg portion 53 is restricted and, therefore, the rear leg portion 53 can be easily inserted into the rear fixing hole 8. In this way, the fixing clip 51 can be easily mounted on the bracket 1. In addition, when the density sensor unit SN1 is dismounted from the copying machine body U1 and if an operator attempts to feel for the bracket 1 to hold the front end of the bracket 1 and happens to push the fixing clip 51 to the left, the rear leg portion 53 is brought into contact with the slant prevention surface 33. Consequently, according to the first exemplary embodiment, even when the fixing clip 51 happens to be pushed to the left, the fixing clip 51 is rarely inclined to the left and rarely falls away from the bracket 1.

Second Exemplary Embodiment

Figure 18A:
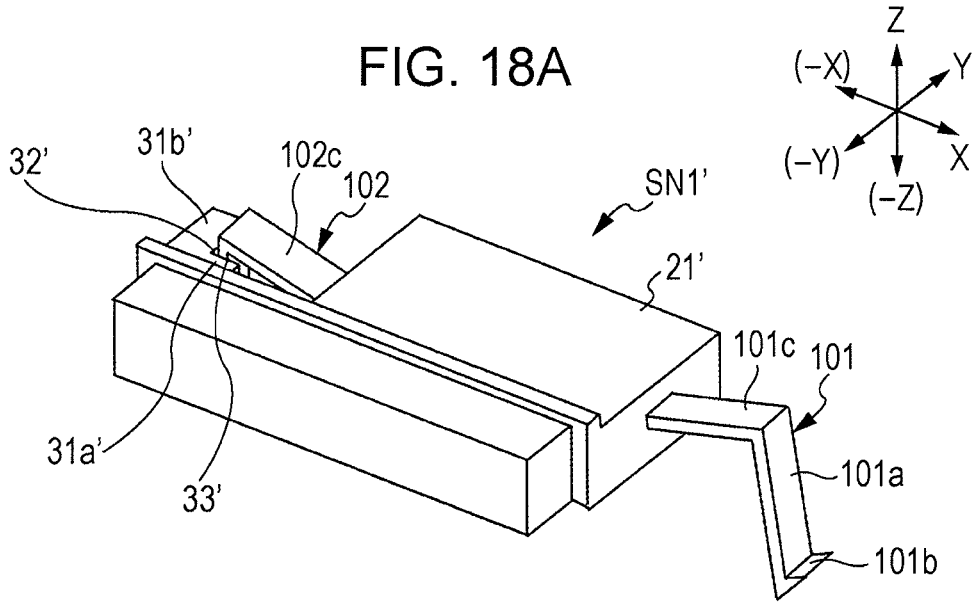
FIGS. 18A and 18B illustrate the components of a detecting unit according to a second exemplary embodiment, where
Figure 18B:
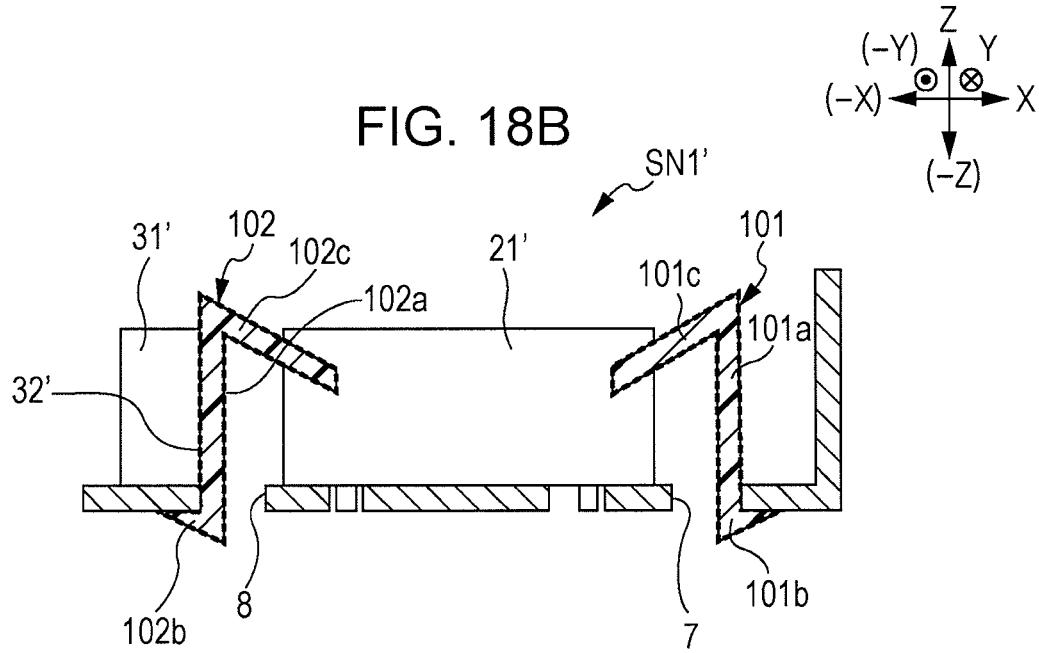

A second exemplary embodiment of the invention is described next. In the second exemplary embodiment, components that correspond to the components of the first exemplary embodiment described above are indicated using the same reference numerals and will not be described in detail again. The second exemplary embodiment differs from the first exemplary embodiment in the following respects. The other respects are the same as those of the first exemplary embodiment. FIGS. 18A and 18B illustrate a detecting unit according to the second exemplary embodiment of the invention. More specifically, FIG. 18A is a perspective view of the detecting unit, and FIG. 18B is a cross-sectional view of the detecting unit supported by a supporting unit. As illustrated in FIGS. 18A and 18B, the fixing clip 51 employed in the first exemplary embodiment is removed from a density sensor unit SN1' of the second exemplary embodiment. A density sensor body 22' of a density sensor 21' has the same configuration as the density sensor body 22 of the density sensor 21. Fixing legs 101 and 102 are supported by the front surface and the rear surface of the density sensor body 22' so as to correspond to the front portion and the rear portion of the fixing clip 51. The fixing leg 101 includes a front leg portion 101*a*, a front hook claw 101*b*, and a front slant portion 101*c* having configurations that are the same as the front leg portion 52, the hook claw 54, and the front slant portion 57 of the first exemplary embodiment, respectively. The fixing leg 102 includes a rear leg portion 102*a*, a rear hook claw 102*b*, and a rear slant portion 102*c* having configurations that are the same as the rear leg portion 53, the hook claw 56, and the rear slant portion 58 of the first exemplary embodiment, respectively.

In addition, the density sensor 21' includes a connector 31' having a configuration that is the same as that of the connector 31 according to the first exemplary embodiment. The connector 31' according to the second exemplary embodiment includes a connector left portion 31*a*', a connector right portion 31*b*', a fixation support surface 32', and a slant prevention surface 33' having configurations that are the same as the connector left portion 31*a*, the connector right portion 31*b*, the fixation support surface 32, and the slant prevention surface 33 according to the first exemplary embodiment. Note that the connector 31' according to the second exemplary embodiment is connected to the density sensor body 22' via a sensor control board 30' having a configuration that is the same as the sensor control board 30 of the connector 31 according to the first exemplary embodiment.

Operation of Second Exemplary Embodiment

Figure 19A:
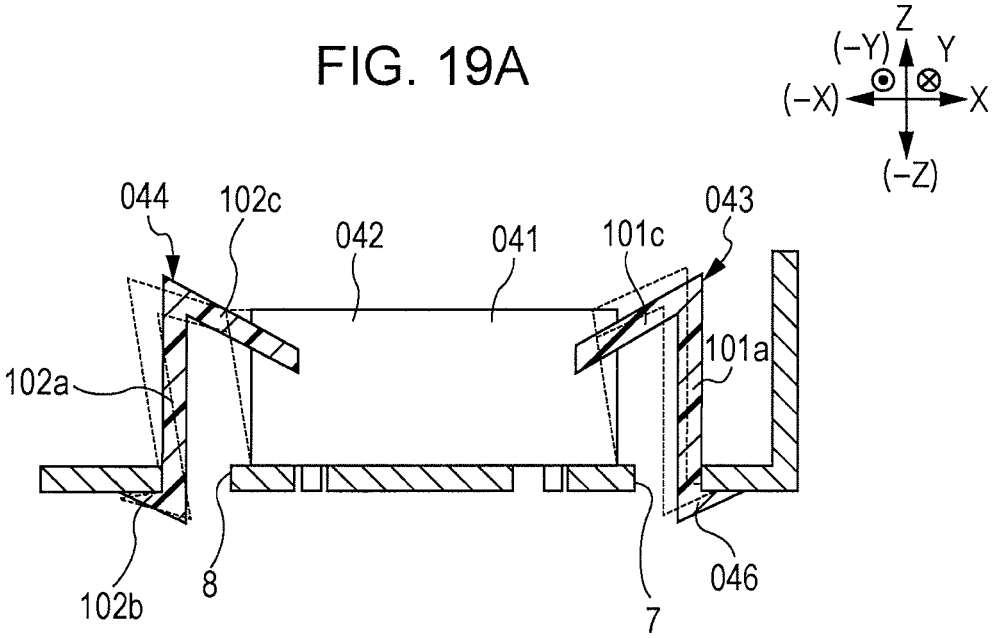
FIG. 19A illustrates the detection member that does not have a disengagement restricting unit.
Figure 19B:
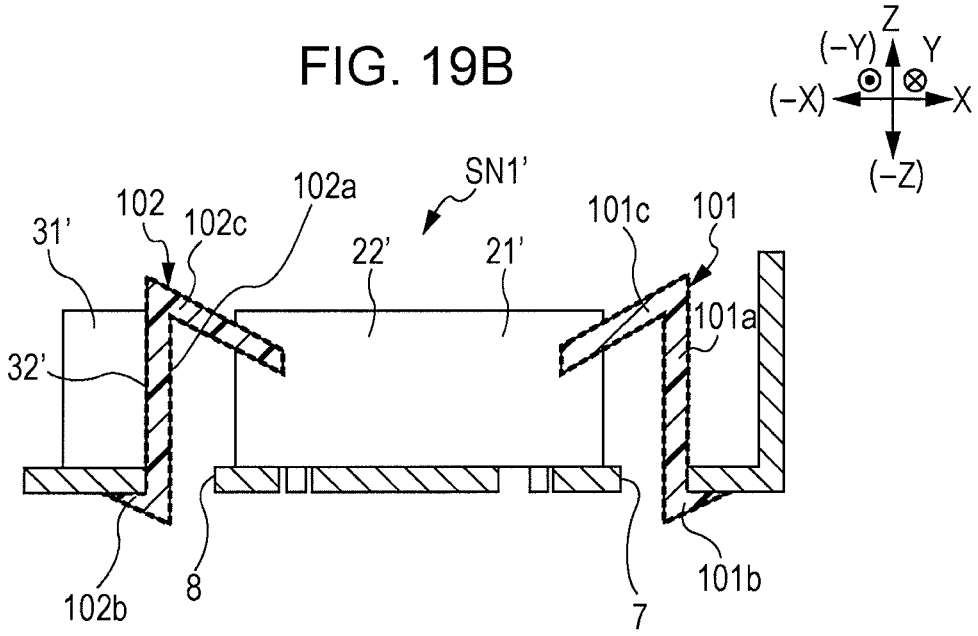
FIG. 19B illustrates a detection member according to a second exemplary embodiment of the invention.

FIGS. 19A and 19B illustrate a detection member that does not have the disengagement restricting unit and the detection member according to the second exemplary embodiment of the invention. More specifically, FIG. 19A illustrates the detection member that does not have the disengagement restricting unit, and FIG. 19B illustrates the detection member according to the second exemplary embodiment of the invention. As illustrated in FIG. 19B, in the density sensor unit SN1' having the above-described configuration according to the second exemplary embodiment, the fixing legs 101 and 102 are supported by the front and rear surfaces of the density sensor body 22'. The fixation support surface 32' is disposed so as to face the rear leg portion 102*a* in close proximity.

In the case where, as illustrated in FIG. 19A, a sensor unit 041 including a density sensor 042 having the front and rear surface that support a front fixing leg 043 and a rear fixing leg 044 is used, when the fixation support surface 32' is not provided and if one finger of an operator touches the upper portion of the front fixing leg 043 and urges the upper portion in the rear direction, the front fixing leg 043 deforms in the rear direction. Thus, a force is applied to the density sensor 042 that supports the front fixing leg 043 in the rear direction. Accordingly, the density sensor 042 may be deformed from the shape illustrated as a solid line in FIG. 18A to the shape illustrated as a dotted line in FIG. 18A. If the density sensor 042 is deformed in the rear direction, the rear fixing leg 044 supported by the density sensor 042 is urged in the rear direction and is deformed. In such a case, a front hook claw 046 of the front fixing leg 043 also receives a force in which the front hook claw 046 moves in the rear direction. Thus, the front hook claw 046 is easily released from the front fixing hole 7. Accordingly, during a mount or dismount operation of the sensor unit 041, the front fixing leg 043 may be pulled out of the front fixing hole 7 and, therefore, the density sensor 042 may fall away.

In contrast, according to the second exemplary embodiment, as illustrated in FIG. 19B, the fixation support surface 32' is disposed so as to face the rear leg portion 102*a* in close proximity. Thus, when the upper portion of the fixing leg 101 is pushed, deformation of the rear leg portion 102*a* is restricted by the fixation support surface 32'. Accordingly, as illustrated by a dotted line in FIG. 19B, the rear fixing leg 102 and the density sensor body 22' are negligibly deformed. Consequently, as in the configuration according to the first exemplary embodiment, the rear hook claw 102*b* is rarely released from the rear fixing hole 8 and, therefore, the rear leg portion 102*a* is rarely pulled out of the rear fixing hole 8. In addition, when deformation of the rear leg portion 102*a* is restricted by the fixation support surface 32' and if the upper portion of the front fixing leg 101 is pushed, the front slant portion 101*c* is deformed. Thus, a downward force is exerted on the density sensor 21'. Accordingly, as in the configuration according to the first exemplary embodiment, the density sensor 21' rarely falls away from the bracket 1.

Furthermore, as in the configuration according to the first exemplary embodiment, in the density sensor unit SN1' according to the second exemplary embodiment, the fixing leg 101 is deformed as illustrated as the dotted line in FIG. 18B. Thus, such a force that causes the front hook claw 101*b* to dig into the edge of the front fixing hole 7 is exerted on the front hook claw 101*b*. Accordingly, as in the configuration according to the first exemplary embodiment, the front hook claw 101*b* is rarely released from the front fixing hole 7 and, therefore, the front leg portion 101*a* is rarely pulled out of the front fixing hole 7. Consequently, as in the configuration according to the first exemplary embodiment, in the density sensor unit SN1' according to the second exemplary embodiment, during a mount or dismount operation, the fixing legs 101 and 102 are rarely pulled out and, therefore, the density sensor 21' rarely falls away.

Still furthermore, in the density sensor unit SN1' according to the second exemplary embodiment, the fixing legs 101 and 102 are supported by the front and rear surfaces of the density sensor body 22', and the density sensor body 22' and the fixing legs 101 and 102 are integrated with each other. In a configuration in which the density sensor body is separated from the fixing clip, if the fixing clip is removed from the bracket in order to replace a density sensor with a new one, the density sensor is separated from the fixing clip. Thus, the risk of losing the fixing clip arises. In contrast, in the configuration according to the second exemplary embodiment, the density sensor body 22' and the fixing legs 101 and 102 are integrated with each other. Accordingly, the risk of losing the fixing clip is decreased, as compared with the configuration in which the density sensor body is separated from the fixing clip. Thus, the workability of mounting or dismounting the density sensor unit SN1' can be increased.

Modifications

While the invention has been described in detail with reference to the exemplary embodiments, the invention is not limited to the above-described exemplary embodiments. Various other changes and modifications can be made within the spirit and scope of the invention as defined by the claims. The following modifications (H01) to (H07) of the invention are such examples. (H01) While the above exemplary embodiments have been described with reference to the copying machine U as an example of an image forming apparatus, the image forming apparatus is not limited to the copying machine U. For example, the invention can be applied to a printer, a FAX, or a multi function peripheral having some or all of the functions of a printer and a FAX. In addition, the image forming apparatus is not limited to a monochrome image forming apparatus. The invention can be applied to a multicolor image forming apparatus. In addition, the image forming apparatus of the invention is not limited to a tandem image forming apparatus. For example, the invention is applicable to a rotary image forming apparatus.

(H02) While the above exemplary embodiments have been described with reference to the connector 31 that is a part of the density sensor 21 and that has the fixation support surface 32, the configuration is not limited thereto. For example, a fixation support unit having the fixation support surface 32 that is separated from the density sensor body 22 may be supported by the bracket 1. Alternatively, the fixation support surface 32 can be formed as part of the bracket 1. Still alternatively, the fixation support surface 32 can be formed as part of the density sensor body 22 different from the connector 31. (H03) While the above exemplary embodiments have been described with reference to the configuration for positioning the bracket 1 and the density sensor 21 in which the sensor positioning slot 9 and the sensor positioning hole 11 are formed in the bracket 1 and the density sensor body 22 has the positioning pins 27 and 28 formed thereon, the configuration is not limited thereto. For example, the bracket 1 may have the pins, and the density sensor body 22 may have the holes. In addition, the number of pins and the number of holes may be changed into any number. Furthermore, the shape of the configuration is not limited to a pin and a hole. For example, the configuration can be of any shape that enables positioning of the bracket 1 and the density sensor 21. Still furthermore, it is desirable that the sensor positioning slot 9 be formed on the front side and the sensor positioning hole 11 be formed on the rear side. However, the sensor positioning slot 9 may be formed on the rear side and the sensor positioning hole 11 be formed on the front side. Yet still furthermore, it is desirable that positioning be enabled using the sensor positioning slot 9 and the sensor positioning hole 11 and the positioning pins 27 and 28. However, the need for positioning may be eliminated and, therefore, the need for the positioning pins 27 and 28 may be eliminated.

(H04) According to the above-described exemplary embodiments, it is desirable that in order to mount the rear leg portions 53 or 102*a* in the rear fixing hole 8, the connector 31 and 31' have the fixation support surface 32 and 32' and the slant prevention surface 33 and 33', respectively. However, the need for the slant prevention surface 33 and 33' may be eliminated. (H05) While the first exemplary embodiment has been described with reference to the configuration in which the density sensor unit SN1 is mounted or dismounted through the mounting port 61 formed in the front surface of the copying machine body U1, the configuration is not limited thereto. For example, the density sensor unit SN1 may be mounted or dismounted through a port formed in a surface other than the front surface of the copying machine body U1 in accordance of the design or the specification of the copying machine body U1. At that time, the fixation support surface 32 may be disposed on the back side from the port, and the protection portion 6 may be provided on the front side. In this way, the operation that is the same as that of the above-described exemplary embodiments can be provided.

(H06) While the above exemplary embodiments have been described with reference to the density sensor units SN1 and SN1' that detect the density of an image formed on the surface of the photorecepter drum PR, the invention is not limited to such a density sensor. For example, the invention is applicable to any sensor that is removably mounted on the copying machine body U1. Examples of such a sensor include a sheet sensor that is disposed in the medium transport path SH and that detects passage or jamming of the sheet S and a sensor that detects the rotational position of a rotation member, such as the photorecepter drum PR. In addition, in a copying machine including an intermediate transfer belt or a medium transport belt, the invention is applicable to a sensor that reads the density of an image formed on the surface of the belt and a sensor that detect wobbling of the belt. (H07) According to the first exemplary embodiment, it is desirable that the fixing clip 51 be formed of a plastic material. However, the material of the fixing clip 51 is not limited thereto. A fixing clip formed of a metal material can be employed instead of the fixing clip 51.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing member that bears a visible image on a surface of the image bearing member;

a detecting unit that is disposed so as to face the image bearing member and that detects a density of a developer on the surface of the image bearing member;

a support member that removably supports the detecting unit and that is supported by a body of the image forming apparatus;

a separating member that is disposed with a space from the detecting unit;

a first connected unit that is disposed on the support member between the separating member and the detecting unit;

a second connected unit that is disposed on the support member on an opposite side of the detecting unit from the first connected unit;

a fixing member that includes a first connecting unit that passes through the space formed between the separating member and the detecting unit and is supported by the first connected unit and a second connecting unit that is supported by the second connected unit, the fixing member fixing the detecting unit to the support member; and a disengagement restricting unit that is disposed on an opposite side of the detecting unit from the separating member so as to be adjacent to the second connecting unit supported by the second connected unit;

wherein if an external force is exerted on the fixing member, the disengagement restricting unit interferes with movement of the second connecting unit and restricts deformation of the fixing member, wherein the disengagement restricting unit has a fixing surface which faces the space formed between the separating member and the detecting unit and the second connecting unit has a contacting surface which faces the fixing surface, and wherein the fixing surface and the contacting surface contact each other.

2. The image forming apparatus according to claim 1, wherein the disengagement restricting unit includes a terminal unit connected to a connecting wire that extends from the body of the image forming apparatus and that is electrically connected to the detecting unit, and wherein the disengagement restricting unit is removable from the support member together with the detecting unit in an integrated manner.

3. The image forming apparatus according to claim 2, wherein the support member is removably supported by the body of the image forming apparatus, and wherein the body of the image forming apparatus has a mounting port through which the support member is mounted or dismounted, and the mounting port is formed so as to be close to the first connected unit of the support member.

4. The image forming apparatus according to claim 2, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

5. The image forming apparatus according to claim 1, wherein the support member is removably supported by the body of the image forming apparatus, and wherein the body of the image forming apparatus has a mounting port through which the support member is mounted or dismounted, and the mounting port is formed so as to be close to the first connected unit of the support member.

6. The image forming apparatus according to claim 1, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

7. An image forming apparatus comprising:

an image bearing member that bears a visible image on a surface of the image bearing member;

a detecting unit that is disposed so as to face the image bearing member and that detects a density of a developer on the surface of the image bearing member;

a support member that removably supports the detecting unit and that is supported by a body of the image forming apparatus;

a separating member that is disposed with a space from the detecting unit;

a first connected unit that is disposed on the support member between the separating member and the detecting unit;

a second connected unit that is disposed on the support member on an opposite side of the detecting unit from the first connected unit;

a fixing member that includes a first connecting unit that passes through the space formed between the separating member and the detecting unit and is supported by the first connected unit and a second connecting unit that is supported by the second connected unit, the fixing member fixing the detecting unit to the support member; and a disengagement restricting unit that is disposed on an opposite side of the detecting from the separating member so as to be adjacent to the second connecting unit supported by the second connected unit;

a unit to be contacted that is disposed on the detecting unit;

wherein if an external force is exerted on the fixing member, the disengagement restricting unit interferes with movement of the second connecting unit and restricts deformation of the fixing member, wherein the fixing member includes a pressing unit that fixes the detecting unit to the support member by contacting the unit to be contacted and urging the detecting unit against the support member.

8. The image forming apparatus according to claim 7, further comprising:

a first pressing connection unit; and a second pressing connection unit;

wherein the unit to be contacted is disposed on an opposite side of the detecting unit from the support member, and wherein a first end representing one end of the first connecting unit is supported by the first connected unit, and a second end representing the other end is located at a position further away from the unit to be contacted, and wherein a third end representing one end of the second connecting unit is supported by the second connected unit, and a fourth end representing the other end is located at a position further away from the unit to be contacted, and wherein the first pressing connection unit diagonally extends from the second end to the pressing unit, and the second pressing connection unit diagonally extends from the fourth end to the pressing unit.

9. The image forming apparatus according to claim 8, wherein the disengagement restricting unit includes a terminal unit connected to a connecting wire that extends from the body of the image forming apparatus and that is electrically connected to the detecting unit, and wherein the disengagement restricting unit is removable from the support member together with the detecting unit in an integrated manner.

10. The image forming apparatus according to claim 9, wherein the support member is removably supported by the body of the image forming apparatus, and wherein the body of the image forming apparatus has a mounting port through which the support member is mounted or dismounted, and the mounting port is formed so as to be close to the first connected unit of the support member.

11. The image forming apparatus according to claim 9, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

12. The image forming apparatus according to claim 8, wherein the support member is removably supported by the body of the image forming apparatus, and wherein the body of the image forming apparatus has a mounting port through which the support member is mounted or dismounted, and the mounting port is formed so as to be close to the first connected unit of the support member.

13. The image forming apparatus according to claim 8, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

14. The image forming apparatus according to claim 7, wherein the disengagement restricting unit includes a terminal unit connected to a connecting wire that extends from the body of the image forming apparatus and that is electrically connected to the detecting unit, and wherein the disengagement restricting unit is removable from the support member together with the detecting unit in an integrated manner.

15. The image forming apparatus according to claim 14, wherein the support member is removably supported by the body of the image forming apparatus, and wherein the body of the image forming apparatus has a mounting port through which the support member is mounted or dismounted, and the mounting port is formed so as to be close to the first connected unit of the support member.

16. The image forming apparatus according to claim 14, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

17. The image forming apparatus according to claim 7, wherein the support member is removably supported by the body of the image forming apparatus, and wherein the body of the image forming apparatus has a mounting port through which the support member is mounted or dismounted, and the mounting port is formed so as to be close to the first connected unit of the support member.

18. The image forming apparatus according to claim 7, further comprising:

a first positioned unit provided on the detecting unit;

a first positioning unit provided in the support member, the first positioning unit engaging with the first positioned unit so as to secure the detecting unit in place;

a second positioned unit provided in one of the detecting unit and the support member so as to be located closer to the first connected unit than each of the first positioned unit and the first positioning unit; and a second positioning unit provided in the other of the detecting unit and the support member, the second positioning unit having a slot shape extending in a direction from the second connected unit to the first connected unit, the second positioning unit engaging with the second positioned unit and ensuring positioning of the detecting unit in a direction that intersects with a direction from the second connected unit to the first connected unit.

* * * * *